US007157198B2

(12) United States Patent
Ohmura et al.

(10) Patent No.: US 7,157,198 B2
(45) Date of Patent: Jan. 2, 2007

(54) TONER FOR ELECTROSTATIC LATENT IMAGE DEVELOPMENT AND AN IMAGE FORMING METHOD

(75) Inventors: Ken Ohmura, Hachioji (JP); Asao Matsushima, Hachioji (JP); Shiro Hirano, Hachioji (JP); Yoshiki Nishimori, Hachioji (JP)

(73) Assignee: Konica Minolta Holdings, Inc, Tokyo (JP)

( * ) Notice: Subject to any disclaimer, the term of this patent is extended or adjusted under 35 U.S.C. 154(b) by 314 days.

(21) Appl. No.: 10/808,578

(22) Filed: Mar. 24, 2004

(65) Prior Publication Data

US 2005/0214665 A1 Sep. 29, 2005

(51) Int. Cl.
*G03G 9/08* (2006.01)

(52) U.S. Cl. ..... 430/108.1; 430/110.1; 430/111.4; 430/124

(58) Field of Classification Search ..... 430/108.1, 430/110.1, 111.4, 124
See application file for complete search history.

(56) References Cited

U.S. PATENT DOCUMENTS

| | | | | |
|---|---|---|---|---|
| 6,190,816 | B1 * | 2/2001 | Takehara et al. | 430/110.4 |
| 6,203,959 | B1 | 3/2001 | Tanikawa et al. | |
| 6,806,012 | B1 * | 10/2004 | Yamauchi et al. | 430/110.3 |

FOREIGN PATENT DOCUMENTS

| | | |
|---|---|---|
| JP | 03-296067 | 12/1991 |
| JP | 05-088409 | 4/1993 |
| JP | 10-161338 | 6/1998 |

* cited by examiner

*Primary Examiner*—John L Goodrow
(74) *Attorney, Agent, or Firm*—Lucas & Mercanti LLP

(57) ABSTRACT

Toner for electrostatic latent image development includes at least a resin, a coloring agent and a crystalline compound, wherein the toner particle has sea-island structure and the crystalline compound is n-paraffin of particular structure.

19 Claims, 4 Drawing Sheets

TONER FOR ELECTROSTATIC LATENT IMAGE DEVELOPMENT AND AN IMAGE FORMING METHOD

BACKGROUND

1. Field of the Invention

The present invention relates to toner for electrostatic latent image development used for copying machines, printers and the like, a method for manufacture thereof, as well as a developer, an image forming method and an image forming apparatus using the same.

2. Description of the Related Art

Recently, in methods for forming images by electrophotography, along with progress of digital technology, an image formation in a digital mode has become predominant. In the method for forming images in the digital mode, it is a basic to manifest a dot image with a small pixel size such as 1200 dpi (dpi: dot number per inch, i.e., 2.54 cm). High-quality picture technology which faithfully reproduces these small dot images has been required, and in terms of such high-quality picture technology, it has been carried forward to make particle sizes of toner small.

As ways for achieving to make particle sizes of toner small and make a particle size distribution and shapes uniform, polymerization toners obtained by suspension polymerization and emulsion polymerization have been noticed. In Tokugan-Hei 11-304004, it is described that the shape, roundness and the particle size distribution can be controlled in the toner obtained by the polymerization.

As methods for fixing a toner picture formed on an image support (sometimes referred to as a transfer material or transfer paper) such as paper, a heat roller fixing mode is widely employed where the image support on which the toner picture has been formed is fixed by passing between a heating roller and a pressing roller. The heat roller fixing mode has a drawback that an offset phenomenon where the melted toner adheres to the heating roller occurs to easily cause image stain.

In order to prevent the offset phenomenon from occurring, it has been known to apply silicone oil on the heating roller of a fixing unit to impart mold release property for the toner to the heating roller. This method has been advantageous in terms of unlimited toner types, but unsuitable for business documents because writing with pens and pencils such as a ballpoint pen becomes difficult due to adhesion of silicone oil onto the transfer paper. In the market, copied documents are instantly used as business documents and writing onto the document is routinely performed. Thus, the method for applying the silicone oil has not met the needs of the times.

In these years, a technology where the mold release property is imparted to the toner itself by adding a mold release agent such as wax in the toner has been employed. In JP-Hei 3-296067A, those where a structure in which polypropylene, a mold release agent is dispersed in a binding resin is formed at a cross section of toner, and a maximum diameter in a long axis direction at island parts of the polypropylene and a mean distance between the islands are specified are disclosed. In JP-Hei 10-161338A, with respect to a mold release agent component of toner in a sea-island structure, those where particle sizes of the mold release agent component before heat fixing are specified and the sea-island structure disappears after the heat fixing are disclosed.

However, even if the mold release agent is introduced in the toner in this way, it has been still necessary to install a cleaning mechanism of a fixing roller. Because although in the toner where the mold release agent is introduced, the offset does not occur in the image formation where printing of several units is performed, when ten to twenty thousand sheets of printing are carried out, then, the toner is gradually accumulated onto the fixing roller and the offset so-called termed non-visual offset occurs. Also in terms of prevention of occurrence of non-visual offset, it is necessary to exchange a cleaning member of the fixing unit (fixing device) every processing of several ten thousand sheets.

Processing performance of the image forming apparatus has been improved and high speed machines having output of 50 or more sheets per minute have appeared. But, in such high speed machines, the fixing is completed before the mold release agent in the toner is sufficiently exuded on the surface of the toner, therefore, the mold release agent contained in the toner can not sufficiently function, and thus not only non-visual offset easily occurs, but also occurrence of the offset at a stage of less sheet processing is resulted.

The toners disclosed in the aforementioned references are obtained by a pulverization method, and the mold release agent takes an orientation in the produced toner by passing through a kneading. When the mold release agent takes an orientation in the toner, the mold release agent component is exuded onto the toner surface according to an orientation direction in the fixing. Therefore, isotropic exudation to all directions of toners is not performed and thus it becomes more difficult to exert an effect of the mold release agent between the fixing roller and the transfer paper. This way, it is an actual situation that those capable of bearing with the use in the high speed machine can not be obtained using the pulverization toner.

Whereas, in terms of making high-quality picture, it has been carried forward to make particle sizes of the toner small, and improvement of compound for mold release agents and technology to increase an addition amount to the toner are studied as shown in JP-Hei 8-41468A. However, when a large amount of the mold release agent is added, there has been problematic in that the mold release agent is liberated from toner particles and the free mold release agent deteriorates a developer, reduces toner fluidity and causes photoconductor filming.

In JP-Hei 5-88409A, polymerization toner where a toner particle structure is specified, having spherical large islands of the mold release agent in a binding resin is disclosed, but those where no island of the mold release agent is present in the toner particles are found because variation of the addition amount of mold release agent to an individual particle is not dissolved. Also, since the shape of the mold release agent in the toner particle is spherical, contact areas between the mold release agent and the resin becomes small, and thus toner deterioration occurs where charging fault of the toner is resulted from detachment of the mold release agent from the toner particle.

Moreover, those in the above references have the structure where one to two islands of the mold release agent with large diameter are present around a middle of the toner particle, and thus, it takes long to make the mold release agent exude onto the toner surface in the fixing. Thus, there is also a problem that a sufficient layer of the mold release agent can not be formed between the fixing roller and the toner. It has not been accomplished that the toner capable of bearing with the use for the high speed machine is brought to market by the conventional technology.

SUMMARY OF THE INVENTION

The present invention has been made based on the aforementioned circumstance.

That is, the first object of the invention is to provide toner for electrostatic latent image development which is excellent in non-visual offset property and where no image stain occurs even when a cumulative sheet number is increased along with a long term use.

The second object of the invention is to provide toner for electrostatic latent image development which is excellent in melting property and fluidity where exudation of a mold release agent onto the toner surface is effectively performed and no twisting jam at the fixation occurs due to the insufficient mold release agent even when used for a high speed machine.

The third object of the invention is to provide toner for electrostatic latent image development having durability, where detachment of a mold release agent from inside the toner is not caused.

The fourth object of the invention is to provide toner for electrostatic latent image development capable of being used for a high speed image forming apparatus having a fixing in which oil and cleaning are not required.

Moreover, the fifth object of the invention is to image forming method using the above toner for electrostatic latent image development.

The invention has made it possible to obtain the toner of the sea-island structure where the islands present in the toner particle are finely dispersed with extremely short distance intervals, the toner with uneven dispersion state having areas where the islands exist thickly or thinly is not formed, and the islands are equally dispersed in any areas in the toner particle, by employing the following configurations.

Toner for electrostatic latent image development of the invention comprises at least a resin, a coloring agent and a crystalline compound wherein;

a toner particle has a sea-island structure, in which a mean value of distances between most proximal walls between islands of the crystalline compound is from 100 to 1060 nm, and percentage of the islands of the crystalline compound in which the distance between the most proximal walls is 1300 nm or more is 10% or less by number in the total islands of the crystalline compound; and the crystalline compound comprises 92% or more by mass of n (normal)-paraffin, and a plurality of types of n-paraffin components with different numbers of carbons, and a peak top temperature of a largest endothermic peak is from 70 to 120° C. in an endothermic curve measured by DSC, a peak width at half height of the largest endothermic peak is 12° C. or less, and a penetration is 4 or less.

In the above toner, the mean value of distances between the most proximal walls between the islands of the crystalline compound is preferably from 260 to 820 nm, and percentage of the islands of the crystalline compound in which the distance between the most proximal walls is preferably 1300 nm or more is 4% or less by number in the total islands of crystalline compound.

The above toner may comprise the resin and coloring particles comprising the coloring agent, wherein the coloring particles comprise at least the coloring particles obtained by polymerizing polymerizable monomer in aqueous vehicle.

The above toner may comprise the resin and coloring particles comprising the coloring agent, wherein the coloring particles comprise at least the coloring particles obtained by aggregating/fusing resin particles in aqueous vehicle.

An endothermic quantity of a peak in a range of 70 to 120° C. in the above endothermic curve in the DSC is preferably from 4 to 30 J/g.

In the above image forming method, the mean value of distances between the most proximal walls between the islands of the crystalline compound is preferably from 260 to 820 nm, and percentage of the islands of the crystalline compound in which the distance between the most proximal walls is 1300 nm or more is preferably 4% or less by number in the total islands of the crystalline compound.

BRIEF DESCRIPTION OF THE DRAWINGS

The present invention will become more fully understood from the detailed description given hereinbelow and the appended drawings. However, they are not intended as a definition of the limits of the present invention, and wherein.

DETAILED DESCRIPTION OF THE EXEMPLARY EMBODIMENTS

Figure 1A:
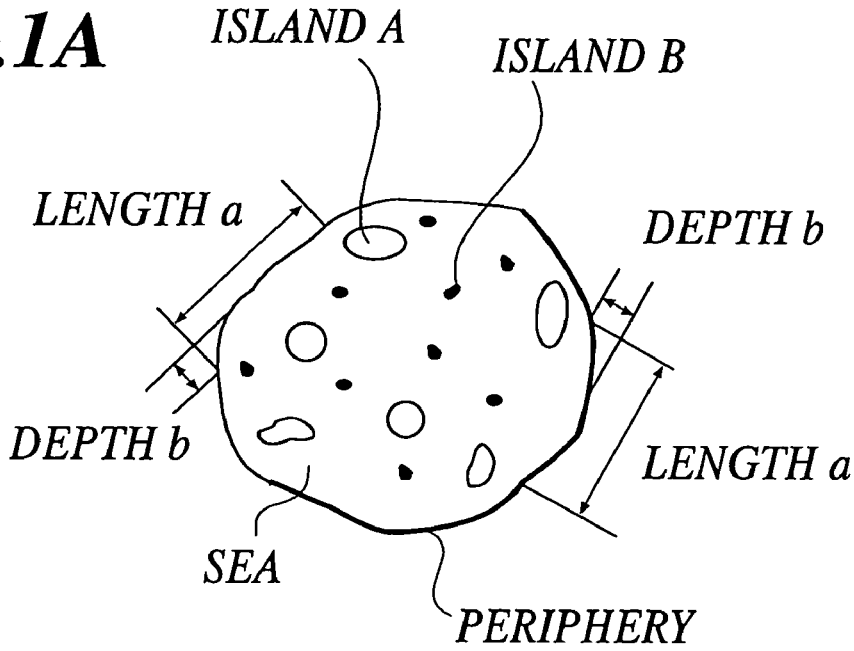
FIGS. 1A and 1B is a schematic view illustrating toner particles having a sea-island structure of the invention.

As a result of an intensive study for solving the above problems, the present inventors have focused attention on a structure of polymerization toner having a sea-island structure obtained by associating resin particles and particles of a crystalline compound of the invention, and have found that the problems of the invention are resolved by controlling and specifying a dispersion state of islands made up of the crystalline compound in a toner particle.

The invention has made it possible to perform exudation of a crystalline compound having a mold release property in toner isotropically and equally in quantity without unevenness regardless of a pressing direction at an image formation by controlling such that islands of the crystalline compound having the mold release property which composes the toner are three-dimensionally disposed without deflection in a toner particle, and has found that consequently the effects including prevention of offset and prevention of uneven gross occurrence are exerted.

Hereinafter, the invention is illustrated in more detail.

The toner particle of the invention has a sea-island structure. The sea-island structure is referred to a structure where an island-like phase having a closed interface (a border between a phase and a phase) exists in a continuous phase. That is, in the toner of the invention, since respective components of a resin, a coloring agent and the crystalline compound which compose the toner particle are not compatibly dissolved one another and each independently form phases, the toner particle has the sea-island structure. According to the nature of toner, the invention takes the structure where islands of the crystalline compounds and islands of the coloring agent exist in the continuous phase of the resin which is a sea.

This way, the toner particle of the invention employs the structure where phases of other constituents exist in island-shapes in the continuous phase. In the invention, it has been found to control dispersibility of the islands of the crystalline compound in the toner particle as well as to sharply reduce an amount of the crystalline compound librated from inside the toner particle by specifying a number of those where a mean value of distances between the most proximal wall between the islands is in the specified range in the toner particle. As a result, the crystalline compound added to the toner particles effectively exerts the function thereof at the image formation, and by this, the above problems including suppression of toner filming occurrence of a photoconductor by improvement of offset property have been accomplished.

That is, in the conventional technology, the crystalline compound added to polymerization toner tends to be difficult to accomplish an appropriate dispersibility in the toner particle, but the invention has solved this problem. A clear reason for accomplishing the isotropic and optimal dispersibility of the crystalline compound in the toner particle is not necessarily elucidated in the invention. Probably it is speculated that particles of the crystalline compound tend to be easily aggregated one another and thus the islands which exhibit an optimal dispersion state can not be formed in the toner particle in the conventional technology. In the invention, it is speculated that this problem has been solved by operating a mechanism where the aggregation of crystalline compound one another is effectively suppressed.

It is believed that exposing no crystalline compound on the toner particle surface and having the uniform dispersibility in the particle effectively prevent simultaneously the above crystalline compound from liberating from inside the toner particle. A reason why the toner particle having such a structure has been formed is not necessarily elucidated. Probably, it is speculated that the crystalline compound having the mold release property used for the toner of the invention is retained by a binding resin in a more stable state when exists inside the toner particle.

On the other hand, even if the crystalline compound exists on the surface of the toner particle, the toner of the invention is manufactured by heating at not less than a melting point of the crystalline compound in an aqueous vehicle, and thus it is speculated that the crystalline compound present on the toner particle surface is also eliminated together with water when the aqueous vehicle is eliminated at a stage of filtrating.

Also, it is speculated to be attributed to a shape of the crystalline compound. That is, it is speculated that the added crystalline compound easily moves in the toner particle because the shape of added and aggregated crystalline compound of the conventional art is spherical or a shape close to a sphere, or that the crystalline compound is not firmly retained in the toner particle and detached from inside the particle because contact areas are small in the toner particle.

Meanwhile, it is speculated that a function where the crystalline compound is not liberated from inside the toner particle and stably and firmly retained in the processes expect fixing and rapidly and certainly exuded out of the toner particle at the heat fixing is imparted because the toner particle of the invention takes a form where the islands of the crystalline compound in the toner particle are firmly retained in the toner particle. A problem of stain is dissolved by forming a protection layer of the crystalline compound with low friction coefficient on a fixed picture surface by the crystalline compound having the mold release function appropriately exuded out of the toner particle. Especially, prevention of stain occurrence produced when bundling and overlaying paper on which image information is placed such as bookbinding is also accomplished.

Figure 1B:
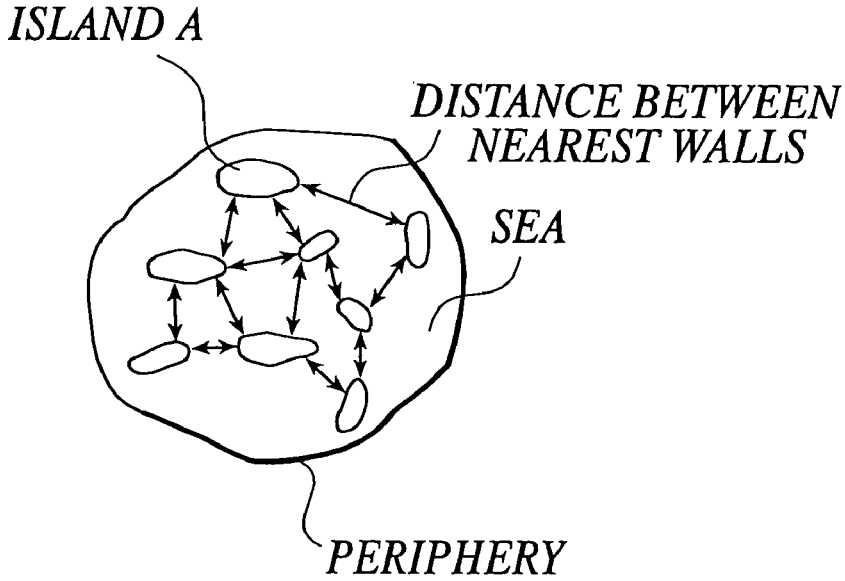

It can be confirmed that the toner particle of the invention has the sea-island structure by the fact having regions with different luminance in the toner particle on a cross sectional photograph of the toner particle photographed by a transmission electron microscope. FIGS. 1A and 1B is a schematic view showing as one example of the toner particle having the sea-island structure of the invention. On an electron micrograph, it is confirmed that the toner particle of the invention is composed of a continuous phase and island parts with different luminance as shown in this schematic view. A region with a length of a and a depth of b having no island part also exists along an periphery of the toner particle.

That is, in the toner particle of the invention, it is confirmed by a transmission electron microscope that granular islands (a phase of the crystalline compound and a phase of the coloring agent) with different luminance are present in a continuous phase (a phase of the binding resin) as shown in the schematic view in FIGS. 1A and 1B. Additionally, based on the result obtained from observation on the transmission electron microscope, factors such as a number of islands in one toner particle, shape coefficient of the island and distance between the most proximal wall of the islands, which specify the sea-island structure in the toner particle can be obtained as numeric values.

The luminance on the transmission electron micrograph is produced by visualizing a difference of electron ray transmittance which occurs due to the difference of crystal states of respective components, i.e., the binding resin, the coloring agent and the crystalline compound, which compose the toner particle. Generally, the coloring agent is photographed as a low luminance because the electron ray transmittance thereof is lower than that of the binding resin, and the crystalline compound is photographed as a higher luminance compared to the binding resin.

On the electron micrograph, a low luminance is referred to one in the range of 0 to 99 gradations, a medium luminance is referred to one in the range of 80 to 160 gradations and a high luminance is referred to one in the range of 127 to 255 gradation when luminance signals of pixels are divided into 256 gradations. But in the invention, the luminance is relative, and so long as the aforementioned constituent factors of the toner particle can be distinguished, respectively by the photograph, the luminance is not necessarily limited to the above ranges. For example, with respect to the island of crystalline compound, when a slice section for the transmission electron microscope observation is placed under an environment at 80 to 120° C., the islands flow out and are observed as voids, and thus it is possible to easily distinguish from the islands of coloring agent.

This way, in the invention, by distinguishing each constituent factor in the toner particle based on the luminance, it is made possible to visually determine and distinguish the sea from the island on the electron micrograph, and the luminance information is converted into visually distinctive image information by an image analyzer installed in an electron microscope apparatus.

In the invention, the crystalline compound which composes the islands is an organic compound having a melting point, and the melting point of the crystalline compound in the toner particle of the invention is a lower temperature than a softening point of the toner and is specifically 130° C. or below.

The toner of the invention has an endothermic peak at 70° C. to 120° C. in a DSC curve, and an endothermic quantity thereof is from 4 to 30 J/g. It can be confirmed by DSC that the crystalline compound which composes the island parts in the toner of the invention has the melting point, and further it can be confirmed by the way such as X-ray diffraction apparatus that the crystalline compound has crystallinity.

Also, the crystalline compound contained in the toner of the invention exerts a function as the mold release agent at the image formation.

The melting point of such a crystalline compound is from 70 to 120° C., more preferably from 70 to 110° C., and especially preferably from 75 to 98° C. In the toner containing the crystalline compound having the melting point in the range of 70 to 120° C., melting viscosity thereof can be reduced and adhesiveness to paper and the like can be improved. Furthermore, even when the crystalline compound exists, since elastic modulus at the high temperature side is maintained in the preferable range, good offset resistant property is exerted. When there are a plurality of endothermic peaks in the range of 70 to 120° C., the endothermic quantity in the invention denotes the sum of the plural endothermic peak in the temperature range.

When the melting point of the crystalline compound is less than 70° C., a fixing property itself is improved, but a storage stability is reduced and problems occur in practicability. Meanwhile when the melting point exceeds 120° C., since a melting starting temperature becomes high, contribution to improvement of the fixing property becomes low and effect exhibition of the fixing property improvement is reduced.

Here, the melting point of the crystalline compound contained in the toner of the invention is referred to a value measured by a differential scanning calorimeter (DSC). Specifically, when temperature rising (first temperature rising process) from 0° C. to 200° C. is performed under a condition at 10° C./min, a temperature which indicates a maximum peak of endothermic peaks measured is rendered the melting point. And this melting point conforms to "an endothermic peak (P1) in the first temperature rising process by DSC" described below.

Specific measuring apparatus for the melting point can include DSC-7 supplied from Perkin Elmer Inc. In the specific method for measuring the melting point by DSC, as a temperature rising/cooling condition, after leaving at 0° C. for one min, the temperature is raised to 200° C. under a condition at 10° C./min, and the temperature which indicates a maximum endothermic peak measured at that time is rendered the endothermic peak P1 in the first temperature rising process. Thereafter, after leaving at 200° C. for one min, the temperature is cooled under the condition at 10° C./min, and the temperature which indicates a maximum exothermic peak measured at that time is rendered the exothermic peak (P2) in the first temperature cooling process.

In the crystalline compound used for the toner of the invention, it is preferred that the endothermic peak (P1) in the first temperature rising process by DSC is in the range of 70 to 120° C., especially from 75 to 98° C. Also, it is preferred that the exothermic peak in the first temperature cooling process by DSC is in the range of 30 to 110° C., especially from 40 to 100° C. Here, for the endothermic peak (P1) and the exothermic peak (P2), a relationship of P1≧P2 is formed. A temperature difference (P1−P2) is not especially limited, but it is preferable to be 50° C. or less.

By containing the crystalline compound having thermal property as the above, it is possible to exert an excellent offset prevention effect (wide temperature range capable of fixing) and excellent fixing property (high fixing rate).

The crystalline compound is sharply dissolved, consequently can lower the melting viscosity of the whole toner, and can enhance the fixing property. Reduction of the elastic modulus at the high temperature side can be suppressed by existing in phase separation one another, and thus the offset resistant property is not impaired.

When the endothermic peak (P1) exists less than 70° C., due to a low melting temperature, the fixing property is enhanced, but the storage stability is reduced. When the endothermic peak (P1) exists in the range of more than 120° C., due to a high melting temperature, consequently, it is not possible to improve the fixing property and the offset resistance.

When the exothermic peak (P2) which indicates a state of recrystallization exists in the range of less than 30° C., the recrystallization can not be achieved unless cooled to a considerably low temperature. Such a substance exists in a low crystalline state in the toner, and can not contribute to enhance the fixing property. When the exothermic peak (P2) exists in the range of more than 110° C., the temperature at which recrystallization occurs is too high, so-called melting temperature also becomes high, and the low temperature fixing property is impaired.

The above DSC can confirm the endothermic peak of the toner of the invention, and at the same time, can measure an endothermic quantity which is a heat quantity thereof. In the toner of the invention, the endothermic quantity of the above endothermic peak is from 4 to 30 J/g, and more preferably from 6 to 24 J/g.

For a transmission electron microscope apparatus by which the structure of the toner particle of the invention can be observed, the structure is sufficiently observed by a machine model typically well-known by those skilled in the art, and for example, "LEM-2000" (supplied from Topcon Corporation) and the like are used. In the invention, values such as numbers of the island parts which are characteristic in the invention, in the toner particle are calculated from planes of projection of 1000 or more toner particles at a magnification of 10,000 folds obtained from results of the transmission electron micrographs.

In the invention, a photographing method using the transmission electron microscope is performed by the method typically known when the toner particle is measured. That is, as the specific method for measuring a fault plane of the toner, a fault conformation of the toner is photographed using a transmission electron microscope (TEM) by thoroughly dispersing the toner in an epoxy resin curable at ambient temperature and subsequently embedding/curing, or by dispersing in styrene fine powder with a particle size of about 100 nm followed by pressing/molding, then if necessary by giving a staining where ruthenium tetroxide and osmium tetroxide are combined to the obtained block and subsequently cutting out a flake-like sample using a microtome comprising a diamond edge. From the photograph, shapes of regions of the crystalline compound in the toner particle are visually confirmed, and the values of Feret's diameter, a number and a shape coefficient of the island parts in the toner particle are obtained by performing conversion processing of the photographed image information using an image processor "Luzex F" (supplied from Nireco Corporation) comprised in the electron microscope apparatus.

The structure of the toner particle of the invention is specified by the above methods. Hereinafter, factors which specify the structure of the toner particle of the invention are illustrated in detail.

In the toner of the invention, a mean value of distances between the most proximal wall in island parts present in the toner particle is from 100 to 1060 nm, and the islands where the distance between the most proximal wall is 1300 nm or more are 10% or less by number in total islands in the toner particle. By fulfilling this condition, it is achieved that the islands made up of the crystalline compound in the toner particle are finely dispersed without unevenness with retaining appropriately short distance intervals. It can be also visually confirmed on the above transmission electron micrograph that the islands of the toner of the invention are finely dispersed without variation in distance intervals.

In the toner of the invention, the mean value of distances between the most proximal wall is from 100 to 1060 nm, and the islands where the above distance between the most proximal wall is 1300 nm or more are 10% or less by number in the total islands in the toner particle. This means that in the variance of islands in the particle, there is no unevenness where there are places where the islands of the crystalline compounds exist in an excessively dense state and places where the islands scarcely exist. That is, in the invention, it is confirmed that the islands are dispersed in an optimal state without unevenness in the toner particle.

The distance between the most proximal walls of the islands in the toner of the invention is referred to a distance between interfaces of the adjacent islands in the toner particle as shown in the schematic view in FIG. 1B by arrows. The average of the distance between the most proximal walls is an arithmetic average of the distances between the most proximal walls. In FIG. 1B, islands B is not illustrated.

In the invention, the mean value of the distances between the most proximal walls is from 100 to 1060 nm in the toner particle, and the number of islands where the distance between the most proximal walls is 1300 nm or more is 10% or less by number in the total islands in the toner. In this range, effective exudation of the crystalline compound is accomplished in the fixing.

In the invention, of course, the number of islands where the distance between the most proximal walls is 1300 nm or more may become 0% by number. That is, that the number of islands where the distance between the most proximal walls is 1300 nm or more is 0% by number means that the islands are finely dispersed with just short distance intervals in a completely even state in the toner particle.

In the toner of the invention, it has been found that those where the crystalline compound which composes the island parts is not exposed on the surface of toner particle are 98% or more in the whole particles when the above mean value of the distances between the most proximal walls is from 100 to 1060 nm and the number of islands having the distance between the most proximal walls of 1300 nm or more is 10% or less by number in total islands in the toner for the islands in the toner.

The islands of the crystalline compound are not exposed on the surface of toner particle, and therefore, the invention has a structure where the islands are difficult to detach from the toner particle. An exposure status of the islands from the toner particle surface and that the toner particles with no exposure of islands exist at 98% or more of the total toner particles are obtained from the aforementioned transmission electron microscope observation and the aforementioned image analyzer. The invention has found the above relationship based on the results of observing 1000 toner particle surfaces.

As mentioned above, the toner of the invention has the islands B of the coloring agent component which can be distinguished by different luminance on the electron micrograph in addition to the islands A of the crystalline compound, and the island of the coloring agent component is represented by an island B in the schematic view (A) in FIGS. 1A and 1B. As is obvious from this schematic view, in the toner particle having the sea-island structure of the invention, the islands of multiple types of toner constituent factors such as the islands of the crystalline compound and the islands of the coloring agent component may be present, and since these different type islands are different in luminance one another, they can be easily distinguished on the electron micrograph.

In the invention, the amount of the crystalline substance contained in the toner particle can be measured by extracting the crystalline substance from the toner particle and measuring the spectral transmission of the extract containing the extracted substance.

The procedure for releasing the crystalline substance to obtain the extract is described below. In the followings, the crystalline substance extracted from the toner, the extract liquid containing extracted crystalline substance measured by the spectral transmission are each referred to as the extracted crystalline substance, the extraction liquid and the extracted crystalline substance amount, respectively.

Procedure for Measuring the Extracted Crystalline Substance Amount

The extracted crystalline substance amount is represented by the absorbance or turbidity of a supernatant liquid which is obtained by centrifuging a suspension which is prepared by dispersing the toner particles in a liquid according to the following procedure. In concrete, the supernatant is prepared in the manner described in (1) to (4), and the absorbance of the supernatant is measured by a spectrometer using light with wavelength of 500 nm from a lamp.

(1) Preparation of a Surfactant Solution

Into a measuring flask of 100 ml, 90 ml of ion-exchanged water is put and 1 ml of an aqueous solution containing 12 parts by weight of sodium dodecylbenzensulfonate is added. Then ion-exchanged water is gradually added to make the volume of the solution to 100 ml. Thus a surfactant solution is prepared.

(2) Suspension of the Toner

Into a glass screw-top bottle of 50 ml, 15 g of the toner is put and 30 ml of the surfactant solution prepared in the above (1) is gradually poured into the bottle. The bottle is capped and shaken for 1 minute to prepare a suspension of the toner.

(3) Centrifugation

The toner suspension prepared in the above (2) is put into a centrifugal precipitation tube of 50 ml. The tube is set on an angle rotor with a rotating radius of 70 mm, and subjected to centrifugation at 5,000 rpm for 20 minutes.

(4) Separation of Supernatant Liquid

Particles of low molecular weight crystalline substance adhered to the inner wall of centrifugal tube by the centrifugation are washed off by the supernatant using a pipette and the supernatant is sampled.

If the precipitated toner particles are mixed into the supernatant, the sample tube is stood to re-precipitate the toner particles or the supernatant is subjected again to the centrifugation to remove the toner particles.

The light absorbance of thus obtained supernatant is measured by a spectral photometer and the amount of the crystalline substance contained in the toner particle is determined according to the spectral absorbance. In the invention, the extracted crystalline substance amount contained in the toner particles is from 70 to 99.5%, preferably from 84 to 99% in terms of spectral transmittance.

Next, particle sizes of the toner of the invention are illustrated.

For the particle size of the toner used in the invention, a number mean particle size is from 3 to 9 μm, preferably from 4.5 to 8.5 am, and more preferably from 5 to 8 μm. This particle size can be controlled by a concentration of coagulant (salting out agent), an addition amount of organic solvent, a fusion time and a composition of polymer in the method for manufacturing the toner.

By making the number mean particle size 3 to 9 μm, transferring efficiency is enhanced, an image quality of half tone is improved and the image quality of thin lines and dots is improved. Calculation of a particle size distribution of the toner and measurement of the number mean particle size can be carried out using Coulter Counter TA-II, Coulter Multisizer (both supplied from Coulter Corp.), SLAD 1100 (laser diffraction type particle size measuring apparatus supplied from Shimadzu Corporation), and the like. In the invention, the measurement and the calculation were performed by using Coulter Multisizer and connecting an interface which output the particle size distribution (supplied from Nikkaki-Bios Co., Ltd.) and a personal computer.

Next, the method for manufacturing the toner of the invention is illustrated.

It is preferred that the toner of the invention is obtained by at least polymerizing a polymerizable monomer in an aqueous vehicle. In this manufacture method, the polymerizable monomer is polymerized by suspension polymerization to prepare resin particles, or emulsion polymerization of the monomer is performed in a liquid (in an aqueous vehicle) to which an emulsified solution of necessary additives is added to prepare resin fine particles, after adding a charge controlling resin particles if necessary, an organic solvent, a coagulant such as salts are added to aggregate/fuse the rein particles.

<Suspension Polymerization>

As one method of the methods for manufacturing the toner of the invention, a charge controlling resin is dissolved in a polymerizable monomer, various constituent materials such as a coloring agent, and if necessary a mold release agent, and further a polymerization initiator are added, and the various constituent materials are dissolved or dispersed in the polymerizable monomer using a homogenizer, sand mill, sand grinder, ultrasonic dispersing machine and the like. This polymerizable monomer where the various constituent materials are dissolved or dispersed is dispersed as oil droplets with a desired size as the toner in an aqueous vehicles containing a dispersion stabilizer using a homomixer, homogenizer and the like. Thereafter, the monomer dispersion is transferred to a reaction apparatus (mixing apparatus), and the polymerization reaction is carried forward by heating. After the termination of the reaction, the toner of the invention is prepared by eliminating the dispersion stabilizer, filtrating, washing and further drying. The "aqueous vehicle" referred to in the invention indicates those where at least 50% or more by mass of water is contained.

<Emulsion Polymerization>

Also, as the method for manufacturing the toner of the invention, it is possible to include the method for preparing by aggregating/fusing resin particles in an aqueous vehicles. This method is not especially limited, and, for example, can include the methods shown in JP-Hei 5-265252A, JP-Hei 6-329947A and JP-Hei 9-15904A. That is, the toner of the invention can be formed by the method for salting out, aggregating and fusing resin particles and dispersion particles of constituent materials such as a coloring agent or multiple fine particles composed of a resin, a coloring agent and the like, in particular, by dispersing these in water using an emulsifier, subsequently salting out by adding a coagulant at not less than a critical aggregation concentration and simultaneously heating/fusing at not less than a glass transition point temperature of a formed polymer itself to form fusion particles and gradually grow particle sizes, adding a large amount of water to stop the growth of particle sizes at a time point when the aimed particle size is obtained, further making the particle surface smooth with heating and stirring to control shapes, and heating/drying at a fluid state with a hydrous condition. Here, a solvent such as alcohol which infinitely dissolves in water may be added concurrently with the coagulant.

In the method for manufacturing the toner of the invention, the toner can be obtained by aggregating/fusing at least composite resin fine particles formed via polymerizing the polymerizable monomer after dissolving the crystalline compound in the polymerizable monomer, and coloring agent particles. The toner of the invention is one where the crystalline compound is liquefied in the polymerizable monomer, and this may be liquefied by dissolving or melting.

The method for manufacturing the toner of the invention is preferably the method of aggregating/fusing the composite resin fine particles obtained by multistage polymerization and the coloring agent particles, and the multistage polymerization is illustrated below.

<Method for Manufacturing Composite Resin Particles Obtained by Multistage Polymerization>

The method for manufacturing the toner of the invention has a following configuration of;

1. multistage polymerization,
2. an aggregating/fusing for obtaining toner particles by aggregating/fusing the composite resin particles and the coloring agent particles,
3. filtrating/washing of filtering off to collect the toner particles from a dispersion system of the toner particles and eliminating surfactants from the toner particles,
4. drying the toner particles given the washing treatment, and
5. adding external additives to the toner particles given the drying treatment.

Hereinafter, each process is illustrated in detail.

[Multistage Polymerization]

A multistage polymerization step is the polymerization method performed to enlarge a molecular weight distribution of the resin particles in order to obtain the toner where occurrence of offset is prevented. That is, it is performed by dividing the polymerization reaction into multiple stages to form phases having different molecular weight distributions in one resin particle, and it is performed by intending to form a molecular weight gradient from a center toward a surface in the obtained particle. For example, the method is employed where initially a resin particle dispersion solution with a high molecular weight is obtained and subsequently a surface layer with a low molecular weight is formed by newly adding a polymerizable monomer and a chain transfer agent.

In the invention, it is preferred that the multistage polymerization with three or more stages is employed in terms of stability of the manufacture and pulverization strength of the obtained toner. Two-stage polymerization and three-stage polymerization which are representatives of the multistage polymerization are illustrated below. In the toner obtained by the multistage polymerization like this, those where the molecular weight is reduced toward the surface layer are preferable in terms of the pulverization strength.

[Two-stage Polymerization]

The two-stage polymerization is the method for manufacturing a composite resin particle composed of a midmost (nucleus) formed from a high molecular weight resin containing the crystalline compound and an outer layer (shell) formed from a low molecular weight resin.

Specifically illustrating this method, a dispersion solution of high molecular weight resin particles containing the crystalline compound is prepared by first dissolving the crystalline compound in a monomer to prepare a monomer solution, then dispersing this monomer solution as oil droplets in an aqueous vehicle (e.g., aqueous solution of surfactant), and subsequently polymerizing this system (first stage polymerization).

Then, a coating layer made up of a low molecular weight resin (polymer of monomer) is formed on the surface of the resin particle by adding a polymerization initiator and a monomer for obtaining the low molecular weight resin to this dispersion solution of the resin particles, and polymerizing the monomer in the presence of the resin particles (second stage polymerization).

[Three-stage Polymerization]

The three-stage polymerization is the method for manufacturing the composite resin particle composed of a midmost (nucleus) formed from a high molecular weight resin, an intermediate layer containing the crystalline compound and an outer layer (shell) formed from a low molecular weight resin. In the toner of the invention, the composite resin particles as the above exist.

Specifically illustrating this method, a coating layer (intermediate layer) made up of a resin containing the crystalline compound (polymer of monomer) is formed on the surface of a resin particle (nucleus particle) to prepare a dispersion solution of composite resin particles (high molecular weight resin-intermediate molecular weight resin), by first adding a dispersion solution of resin particles obtained by polymerization (first stage polymerization) according to the standard method to an aqueous vehicle (e.g., aqueous solution of surfactant) and dispersing a monomer solution where the crystalline compound is dissolved in a monomer as oil droplets in the above aqueous vehicle, and subsequently polymerizing this system (second stage polymerization).

Then, a coating layer made up of a low molecular weight resin (polymer of monomer) is formed on the surface of the composite resin particle by adding a polymerization initiator and a monomer for obtaining the low molecular weight resin to the obtained dispersion solution of the composite resin particles and polymerizing the monomer in the presence of the composite resin particles (third-stage polymerization). In the above method, the crystalline compound can be finely and uniformly dispersed by incorporating the intermediate layer, and thus it is preferable.

In the method for manufacturing the toner according to the invention, it is preferred that the polymerizable monomer is polymerized in the aqueous vehicle. That is, latex particles are obtained by dissolving the crystalline compound in the monomer, dispersing the resultant monomer solution as oil droplets in the aqueous vehicle, and polymerizing by adding the polymerization initiator to this system when the resin particles (nuclear particles) or the coating layer (intermediate layer) containing the crystalline compound are formed.

The aqueous vehicle referred to in the invention is referred to the vehicle made up of 50 to 100% by mass of water and 0 to 50% by mass of water-soluble organic solvent. As the water-soluble organic solvent, for example, it is possible to exemplify methanol, ethanol, isopropanol, butanol, acetone, methylethylketone, tetrahydrofuran and the like, and alcohol type organic solvents which do not dissolve the resultant resin are preferable.

Here, a dispersing machine for dispersing as oil droplets by mechanical energy is not especially limited, and for example, can include a mixing apparatus comprising a rotor rotating at a high speed, "Clearmix" (supplied from M Technique Co., Ltd.), an ultrasonic dispersing machine, a mechanical homogenizer, Manton Gaulin, and a press type homogenizer and the like. Dispersed particle sizes are from 10 to 1000 nm, preferably from 50 to 1000 nm, and more preferably from 30 to 300 nm. Phase separation structures, i.e., Feret's diameter, a shape coefficient and variation coefficients thereof of the crystalline compound in the toner particle may be controlled by making the dispersed particle size have a distribution.

It is preferred that the particle size of the composite resin particles obtained in this polymerization are in the range of 10 to 1000 nm as a weight mean particle size measured using an electrophoretic light scattering spectrophotometer, "ELS-800" supplied from Otsuka Electronics Co., Ltd.

The glass transition temperature (Tg) of the composite resin particles is preferably in the range of 48 to 74° C., and more preferably from 52 to 64° C.

It is preferred that the softening point of the composite resin particles is in the range of 95 to 140° C.

The toner of the invention is preferably obtained by forming a resin layer made by fusing resin particles on the surface of resin and coloring agent by aggregation/fusion. This is illustrated below.

[Aggregating/Fusing]

This aggregating/fusing is one obtaining the toner particles in an uneven shape (non-sphere) by aggregating/fusing (simultaneously performing salting out and fusion), for example, the composite resin particles obtained by the above multistage polymerization and the coloring agent particles.

Aggregation/fusion referred to in the invention is referred to simultaneous performing of salting out (aggregation of particles) and fusion (disappearance of interface between the particles) or an action to simultaneously perform the salting out and the fusion. In order to simultaneously perform the salting out and the fusion, it is necessary to aggregate the particles (composite resin particles, coloring agent particles) under a temperature condition not less than the glass transition temperature (Tg) of the resins which compose the composite resin particle.

In this aggregating/fusing, internal additive particles such as a charge controlling agent (fine particles with a number mean particle size of 10 to 1000 nm) may be aggregated/fused together with the composite resin particles and the coloring agent particles. The surface of coloring agent particle may be modified, and those conventionally known in the art can be used as a surface modifier.

The coloring agent particles are aggregated/fused in a dispersed state in the aqueous vehicle. The aqueous vehicle in which the coloring agent particles are dispersed is preferably an aqueous solution in which a surfactant is dissolved at a concentration not less than a critical micelle concentration (CMC).

A dispersing machine used for the dispersion of the coloring agent particles is not especially limited, and preferably includes a mixing apparatus comprising a rotor which rotates at a high speed, "Clearmix" (supplied from M Technique Co., Ltd.), an ultrasonic dispersing machine, a mechanical homogenizer, Manton Gaulin, press dispersing machines such as press type homogenizers, medium type dispersing machines such as Gettman mill and diamond fine mill.

In order to aggregate/fuse the composite resin particles and the coloring agent particles, it is necessary to add a salting out agent (coagulant) at not less than a critical aggregation concentration into a dispersion solution in which the composite resin particles and the coloring agent particles are dispersed and to heat this dispersion solution at not less than the glass transition temperature (Tg) of the composite resin particles.

A suitable temperature range for aggregating/fusing is from (Tg+10) to (Tg+50° C.), and especially preferably from (Tg+15) to (Tg+40° C.). In order to effectively perform the fusion, an organic solvent which infinitely dissolves in water may be added.

[Maturation]

A maturation follows the aggregating/fusing, where phase separation of the crystalline compound is induced by retaining a temperature close to the melting point of the crystalline compound, preferably at the melting point±20° C. even after the fusion of the resin particles and continuously stirring at a constant strength. In the maturation, it is possible to control Feret's diameter, a shape coefficient and variation coefficients thereof of the crystalline compound.

In the invention, after obtaining colored particles (in the invention, also referred to as toner particles) by salting out, aggregating and fusing the resin particles and the coloring agent particles in the aqueous vehicle, when the toner particles are separated from the aqueous vehicle, it is preferable to perform it at a temperature not less than Krafft temperature of the surfactant present in the aqueous vehicle, and more preferably it is performed at the temperature range of Krafft temperature or above (Krafft temperature+20° C.)

The above Krafft temperature is the temperature at which an aqueous solution containing the surfactant starts to become clouded, and the measurement of Krafft temperature is carried out as follows.

[Measurement of Krafft Temperature]

A solution where the coagulant at an amount actually used is added to the aqueous vehicle used in salting out, aggregating and fusing, i.e., a surfactant solution was prepared, and this solution was stored at 1° C. for 5 days. Then, this solution was gradually heated with stirring until became clear. The temperature at which the solution has become clear is defined as Krafft temperature.

In the light of suppressing excessive charging to the toner particles and imparting uniform charging property, especially in order to stabilize and maintain the charging property for the environment, it is preferred that the toner for electrostatic latent image development of the invention contains a metal element described above (forms include metals, metallic ions, and the like) at 250 to 20000 ppm, more preferably from 800 to 5000 ppm in the toner.

In the invention, it is preferred that a total value of a bivalent (trivalent) metal element used for the coagulant and a monovalent metal element added as an aggregation stopping agent described below is from 350 to 35000 ppm.

A residual amount of metallic ions in the toner can be obtained by measuring a fluorescent X-ray intensity emitted from a metal type (e.g., calcium derived from calcium chloride) of a metal salt used as the coagulant using a fluorescent X-ray analyzer "System 3270 type" (supplied from Rigaku Denki Kogyo KK). As a specific measurement method, multiple toners where a content of a coagulant metal salt is known are prepared, 5 g of each toner is made into pellets, a relationship (calibration curve) of the content of the coagulant metal salt (mass ppm) and a fluorescent X-ray intensity from a metal type of the metal salt (peak intensity) is measured. Then, the toner where a content of a coagulant metal salt is to be measured is also made into pellets, the fluorescent X-ray intensity from the metal type of the metal salt is measured, and the content, i.e., "the residual amount of metallic ions in the toner" can be calculated.

[Filtrating/Washing]

In filtrating/washing, a filtration treatment where toner particles are filtered off from the dispersion system of the toner particles obtained and a wash treatment where extraneous matters such as a surfactant and salting out agent are eliminated from the collected toner particles (cake-like assembly) are given. Here, filtration methods are a centrifugation method, filtration under reduced pressure using Nutshe, filtration using filter press and the like, and are not especially limited.

[Drying]

In drying the washed toner particles are dried.

As a dryer used, a spray dryer, a vacuum freezing dryer, a reduced-pressure dryer, and the like can be included, and it is preferable to use a standing shelf dryer, a moving type shelf dryer, a fluidized bed dryer, a rotating dryer, a agitating dryer, and the like.

A water content of the toner particles given the drying treatment is preferably 5% or less, and more preferably 2% or less by mass.

When the toner particles given the drying treatment are agglutinated one another by weak attracting force between the particles, a cracking treatment may be given to the agglutinate. Here, as a cracking treatment apparatus, mechanical cracking apparatuses such as a jet mill, Henschel mixer, a coffee mill, and a food processor can be used.

It is preferred that the toner of the invention is prepared by forming composite resin particles in the absence of a coloring agent, adding a dispersion solution of coloring agent particles to a dispersion solution of the composite resin particles, and aggregating/fusing the composite resin particles and the coloring agent particles.

This way, by performing the preparation of composite resin particles in the system where the coloring agent is absent, the polymerization reaction for obtaining the composite resin particles is not inhibited. Thus, according to the toner of the invention, excellent offset resistance is not impaired, and stain of a fixing unit and image stain due to accumulation of the toner do not occur.

The polymerization reaction for obtaining the composite resin particles is certainly performed. Consequently, no monomer and oligomer remain in the resultant toner particles. In a hest fixing in the method for forming images using the toner, no nasty smell occurs.

Furthermore, since a surface property of the resultant toner particles is homogenous and a charging quantity distribution becomes sharp, it is possible to form images excellent in sharpness over a long term. According to the toner where compositions, molecular weights and surface property among the toner particles are homogenous, in the method for forming images including a fixing by a contact heating mode, as maintaining good adhesiveness (high fixing strength) to an image support, the offset resistance and twisting prevention can be improved, and the images with appropriate gloss can be obtained.

Next, respective constituent factors used in a toner manufacturing are illustrated in detail.

(Polymerizable Monomer)

As a polymerizable monomer for making a resin (binder) used for the invention, a hydrophobic monomer is an essential constituent ingredient, and if necessary, a crosslinkable monomer is used. Also like the following, it is desirable to contain at least one type of a monomer having acid polar groups or a monomer having basic polar groups in the structure.

(1) Hydrophobic Monomer

Hydrophobic monomers which compose the monomer component are not especially limited, and it is possible to use monomers conventionally known in the art. To satisfy the required properties, it is possible to use one or two or more monomers in combination.

Specifically, monovinyl aromatic type monomers, (meth) acrylate ester type monomers, vinyl ester type monomers, vinyl ether type monomers, monoolefin type monomers, diolefin type monomers, olefin halide type monomers and the like can be used.

The vinyl aromatic type monomers include, for example, styrene type monomers such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene and 3,4-dichlorostyrene, and derivatives thereof.

The (meth)acrylate ester type monomers include, for example, methyl acrylate, ethyl acrylate, butyl acrylate, acrylate-2-ethylhexyl, cyclohexyl acrylate, phenyl acrylate, methyl methacrylate, ethyl methacrylate, butyl methacrylate, hexyl methacrylate, methacrylate-2-ethylhexyl, ethyl β-hydroxyacrylate, propyl γ-aminoacrylate, stearyl methacrylate, dimethylaminoethyl methacrylate, diethylaminoethyl methacrylate, and the like.

The vinylester type monomers include, for example, vinyl acetate, vinyl propionate, vinyl benzoate, and the like, and the vinylether type monomers include, for example, vinylmethylether, vinylethylether, vinylisobutylether, vinylphenylether and the like.

The monoolefin type monomers include, for example, ethylene, propylene, isobutyrene, 1-butene, 1-pentene, 4-methyl-1-pentene and the like, and the diolefin type monomers include, for example, butadiene, isoprene, chloroprene and the like.

(2) Crosslinkable Monomer

To improve the properties of the resin particles, a crosslinkable monomer may be added. The crosslinkable monomers include, for example, those having two or more unsaturated bonds such as divinylbenzene, divinylnaphthalene, divinylether, diethyleneglycol methacrylate, ethyleneglycol dimethacrylate, polyethyleneglycol dimethacrylate and diallyl phthalate.

(3) Monomers Having Acid Polar Groups

The monomers having acid polar groups can include (a) α, β-ethylenical unsaturated compounds having carboxylic group (—COOH) and (b) α, β-ethylenical unsaturated compounds having sulfonic group (—$SO_3H$).

Examples of (a) α, β-ethylenical unsaturated compounds having carboxylic group can include acrylic acid, methacrylic acid, fumaric acid, itaconic acid, cinnamic acid, monobutyl maleate ester, monooctyl maleate ester, and metal (such as Na and Zn) salts thereof and the like.

Examples of (b) α, β-ethylenical unsaturated compounds having sulfonic group can include sulfonated styrene and Na salts thereof, allyl sulfosuccinic acid, octyl allyl sulfosuccinate and Na salts thereof.

(4) Monomers Having Basic Polar Group

As monomers having basic polar groups, (i) (meth)acrylate esters of aliphatic alcohol with 1 to 12, preferably from 2 to 8 and especially preferably 2 carbons having amine group or quaternary ammonium group, (ii) (meth)acrylic acid amide or (meth)acrylic acid amide mono- or di-substituted with alkyl group with 1 to 18 carbon atoms on any N, (iii) vinyl compounds substituted with heterocyclic group having N as ring member and (iv) N,N-diaryl-alkylamine or quaternary ammonium salts thereof can be exemplified. Among others, (i) (meth)acrylate esters of aliphatic alcohol having amine group or quaternary ammonium group are preferable as the monomers having basic polar groups.

Examples of (i) the (meth)acrylate esters of aliphatic alcohol having amine group or quaternary ammonium group can include dimethylaminoethyl acrylate, dimethylaminoethyl methacrylate, diethylaminoethyl acrylate, diethylaminoethyl methacrylate, quaternary ammonium salts of the above four compounds, 3-dimethylaminophenyl acrylate, 2-hydroxy-3-metacryloxypropyltrimethyl ammonium salts, and the like.

The (meth)acrylic acid amide or (meth)acrylic acid amide optionally mono- or di-substituted with alkyl (ii) can include acrylamide, N-butylacrylamide, N,N-dibutylacrylamide, piperidylacrylamide, methacrylamide, N-butylmethacrylamide, N,N-dimethylacrylamide, N-octadecylacrylamide, and the like.

The vinyl compounds substituted with heterocyclic group having N as ring member (iii) can include vinylpyridine, vinylpyrrolidone, vinyl-N-methylpyridinium chloride, vinyl-N-ethylpyridinium chloride, and the like.

Examples of (iv) the N,N-diaryl-alkylamine can include N,N-diallylmethylammonium chloride, N,N-diallylethylammonium chloride and the like.

(Polymerization Initiator)

Radical polymerization initiators used for the invention can be appropriately used so long as they are water-soluble. For example, persulfate salts (potassium persulfate, ammonium persulfate, etc), azo type compounds (4,4'-azobis-4-cyanovaleric acid and salts thereof, 2,2'-azobis(2-amidinopropane) salts, etc), peroxide compounds, and the like are included. Furthermore, the above radical polymerization initiator can be made into a redox type initiator by combining with a reducing agent if necessary. By the use of the redox type initiator, polymerization activity is increased, and thus it is possible to lower the polymerization temperature and further accomplish shortening of polymerization time.

The polymerization temperature is not especially limited so long as it is not lower than the lowest temperature for radical generation of the polymerization initiator, but is in the range of, for example, from 50° C. to 90° C. But, it is also possible to polymerize at ambient temperature or above by the use of the polymerization initiator which initiates at ambient temperature, such as a combination of hydrogen peroxide and the reducing agent (ascorbic acid, etc).

(Chain Transfer Agent)

For the purpose of adjusting the molecular weight, a chain transfer agent known in the art can be used. The chain transfer agent is not especially limited, and for example, compounds having mercapto groups such as octyl mercaptan, dodecyl mercaptan and tert-dodecyl mercaptan are used. In particular, the following compounds are preferably used because the toner where the molecular weight distribution is sharp is obtained and the toner is excellent in storage stability, fixing strength and offset resistance. For example, ethyl thioglycolate, propyl thioglycolate, butyl thioglycolate, t-butyl thioglycolate, 2-ethylhexyl thioglycolate, octyl thioglycolate, decyl thioglycolate, dodecyl thioglycolate, compounds having mercapto group of ethyleneglycol, compounds having mercapto group of neopentylglycol, and compounds having mercapto group of pentaerythritol can be included. In these, in the light of suppressing odor at heat fixing of the toner, n-octyl-3-mercaptopropionate ester is especially preferable.

(Surfactants)

In order to perform the polymerization using the aforementioned polymerizable monomer, it is preferable to perform dispersion as oil droplets in the aqueous vehicle using a surfactant. The surfactants which can be used at that time are not especially limited, and can include the following ionic surfactants as examples of suitable compounds.

The ionic surfactants include, for example, sulfonate salts (sodium dodecylbenzenesulfonate, sodium arylalkylpolyethersulfonate, sodium 3,3-disulfonediphenyl urea-4,4-diazo-bis-amino-8-naphthol-6-sulfonate, sodium ortho-carboxybenzene-azo-dimethylaniline, sodium 2,2,5,5-tetramethyl-triphenylmethane-4,4-diazo-bis-β-naphthol-6-sulfonate, etc), sulfate ester salts (sodium dodecylsulfate, sodium tetradecylsulfate, sodium pentadecylsulfate, sodium octylsulfate, etc), fatty acid salts (sodium oleate, sodium laurate, sodium caprate, sodium caprylate, sodium caproate, potassium stearate, calcium oleate, etc), and the like.

In the invention, the surfactants represented by the following general formulae are especially preferably used.

$R^1(OR^2)_nOSO_4M$ General formula (1)

$R^1(OR^2)_nSO_3M$ General formula (2)

In the general formulae (1) and (2), R1 represents an alkyl or arylalkyl group with 6 to 22 carbons, and is preferably an alkyl or arylalkyl group with 8 to 20 carbons, more preferably an alkyl or arylalkyl group with 9 to 16 carbons.

Alkyl groups with 6 to 22 carbons represented by $R^1$ include, for example, n-hexyl, n-heptyl, n-octyl, n-decyl, n-undecyl, n-hexadecyl, cyclopropyl, cyclopentyl, cyclohexyl groups and the like, and arylalkyl groups represented by $R^1$ include benzyl, diphenylmethyl, cinnamyl, styryl, trityl, phenethyl groups and the like.

In the general formulae (1) and (2), $R^2$ represents an alkylene group with 2 to 6 carbons, and is preferably an alkylene group with 2 to 3 carbons. Alkylene groups with 2 to 6 carbons represented by $R^2$ include ethylene, trimethylene, tetramethylene, propylene, ethylethylene groups and the like.

In the general formulae (1) and (2), n is an integer of 1 to 11, preferably from 2 to 10, more preferably from 2 to 5, and especially preferably from 2 to 3.

In the general formulae (1) and (2), monovalent metal elements represented by M include sodium, potassium and lithium. Among others, sodium is preferably used.

Specific examples of the surfactants represented by the general formulae (1) and (2) are shown below, but the invention is not limited thereto.

$C_{10}H_{21}(OCH_2CH_2)_2OSO_3Na$ Compound (101)

$C_{10}H_{21}(OCH_2CH_2)_3OSO_3Na$ Compound (102)

$C_{10}H_{21}(OCH_2CH_2)_2OSO_3Na$ Compound (103)

$C_{10}H_{21}(OCH_2CH_2)_3OSO_3Na$ Compound (104)

$C_8H_{17}(OCH_2CH(CH_3))_2OSO_3Na$ Compound (105)

$C_{18}H_{37}(OCH_2CH_2)_2OSO_3Na$ Compound (106):.

In the invention, in the light of holding a charging retention function of the toner at a good state, suppressing occurrence of photographic fog and enhancing transfer property under high temperature and humidity, and in the light of suppressing an increase of charging quantity and stabilizing development quantity under low temperature and humidity, the content of the surfactants represented by the general formulae (1) and (2) in the toner for electrostatic latent image development is preferably from 1 to 1000 ppm, more preferably from 3 to 500 ppm, and especially preferably from 7 to 100 ppm.

In the invention, by making the amount of the surfactants contained in the toner the range described above, it is possible that the charging property of the toner for electrostatic latent image development of the invention is always imparted and maintained in a uniform and stable state without being influenced by the environment.

The content of the surfactants represented by the above general formulae (1) and (2) contained in the toner for electrostatic latent image development of the invention is calculated by the method shown below.

The toner (1 g) is dissolved in 50 ml of chloroform, and the surfactants are extracted with 100 ml of ion-exchange water from a chloroform layer. The extracted chloroform layer is further extracted with 100 ml of ion-exchange water once more to obtain total 200 ml of extract solution (water layer), and this extract solution is diluted to 500 ml.

Using this solution as a test solution, according to the method defined in JIS 33636 section, a color is developed with methylene blue, an absorbance is measured, and the content of the surfactants in the toner is measured by a calibration curve separately made.

For a structure of the surfactant represented by the general formula (1) or (2), the above extract was analyzed using $^1$H-NMR to determine the structure.

In the invention, non-ionic surfactants can be also used, and specifically polyethylene oxide, polypropylene oxide, a combination of polypropylene oxide and polyethylene oxide, ester of polyethyleneglycol and higher fatty acid, alkylphenolpolyethylene oxide, ester of higher fatty acid and polyethyleneglycol, ester of higher fatty acid and polypropylene oxide, sorbitan ester, and the like, are included.

In the invention, these surfactants are primarily used as emulsifiers at the emulsion polymerization, but may be used in other processes and purposes.

(Molecular Weight Distributions of Resin Particles, Toner)

In the toner of the invention, peaks or shoulders of the molecular weight distribution exist preferably at 10,000 to 1,000,000 and 1,000 to 50,000, and more preferably the peaks or the shoulders of the molecular weight distribution exist at 100,1000 to 1,000,000, 25,000 to 150,000 and 1,000 to 50,000.

For the molecular weight of the resin particles, the resin containing at least both components of a high molecular weight component which has a peak or a shoulder in the area of 100,000 to 1,000,000 and a low molecular weight component which has a peak or a shoulder in the area of 1,000 to less than 5,000 is preferable, and more preferably, it is preferable to use the resin with an intermediate molecular weight having a peak or a shoulder in the part of 15,000 to 100,000.

As the method for measuring the molecular weight of the aforementioned toner or resin, the measurement by GPC (gel permeation chromatography) using THF (tetrahydrofuran) as a solvent is good. That is, 1.0 ml of THF is added to 0.5 to 5.0 mg, specifically 1 mg of a measurement sample, and thoroughly dissolved by stirring at room temperature using a magnetic stirrer and the like. Then, the sample is treated with a membrane filter with a pore size of 0.45 to 0.50 μm, and subsequently injected in GPC. As a measurement condition of GPC, a column is stabilized at 40° C., THF is run at a flow rate of 1 ml/min, and about 100 μl of the sample at 1 mg/ml is injected to measure. It is preferable to use as the column by combining commercially available polystyrene gel columns. For example, the columns can include the combinations of Shodex GPC KF-801, 802, 803, 804, 805, 806 and 807 supplied from Showa Denko K.K. and the combinations of TSK Gel G1000H, G2000H, G3000H, G4000H, G5000H, G6000H, G7000H and TSK guard column supplied from Tosoh Corporation, and the like. Also it is preferable to use an index of refractive detector (IR detector) or a UV detector as a detector. In the molecular weight measurement of the sample, the molecular weight distribution which the sample has is calculated using a calibration curve measured using monodisperse polystyrene standard particles. About 10 types of polystyrene are preferably used for making the calibration curve.

(Coagulant)

In the invention, in salting out, aggregating and fusing the resin particles in the dispersion solution of the resin particles prepared in the aqueous vehicle, a metal salt can be preferably used as a coagulant, and it is more preferable to use the bivalent or trivalent metal salt as the coagulant. The reason is that it is preferable because the critical aggregation concentration (coagulation value or coagulation point) is smaller in the bivalent or trivalent metal salt than the monovalent metal salt.

The coagulant used in the invention includes, for example, monovalent metal salts which are the salts of alkali metals such as sodium, potassium and lithium, bivalent metal salts which are the salts of alkali earth metals such as calcium and magnesium, or manganese and copper, and trivalent metal salts which are the salts of iron and aluminium, and the like.

Specific examples of these metal salts are shown below. The monovalent metal salts include sodium chloride, potassium chloride and lithium chloride, the bivalent metal salts include calcium chloride, zinc chloride, copper sulfate, magnesium sulfate, manganese sulfate and the like, and the trivalent metal salts include aluminium chloride, iron chloride and the like. These are appropriately selected depending on the purpose, but the bivalent or trivalent metal salts where the critical aggregation concentration is small are preferable.

This critical aggregation concentration referred to in the invention is an index for stability of a dispersed matter in an aqueous dispersion solution and indicates an addition concentration of the coagulant at which aggregation occurs by adding the coagulant. This critical aggregation concentration greatly varies depending on latex itself and a dispersant. It is described in, for example, Kobunshi Kagaku 17, 601 (1960) written by Seizo Okamura et al., and the like, and according to these descriptions, the value can be known. As another technique, the desired salt with varying concentrations is added to an aimed particle dispersion solution, ζ (zeta) potential of the dispersion solution is measured, and a salt concentration at which the ζ potential starts to change can be made the critical aggregation concentration.

In the invention, a polymer fine particle dispersion solution is treated using the metal salt to become a concentration not less than the critical aggregation concentration. At that time, understandably, whether the metal salt is directly added or added as an aqueous solution is optionally selected depending on the purpose. When added as the aqueous solution, it is required that the concentration of added metal salt based on a total volume of the polymer particle dispersion solution and the aqueous solution of the metal salt become not less than the critical aggregation concentration of polymer particles.

In the invention, the concentration of metal salt could be not less than the critical aggregation concentration, but the metal salt is preferably added at 1.2 times or more, and more preferably 1.5 times or more of the critical aggregation concentration.

(Coloring Agent)

The toner of the invention is obtained by aggregating/fusing the above composite resin particles and coloring agent particles. The coloring agent (coloring agent particles given to the aggregation/fusion with the composite resin particles) which composes the toner of the invention can include various inorganic pigments, organic pigments and dyes. As the inorganic pigments, those conventionally known in the art can be used. Specific inorganic pigments are exemplified below.

As black pigments, carbon black such as furnace black, channel black, acetylene black, thermal black and lamp black, and further magnetic powder such as magnetite and ferrite are used.

It is possible to use these inorganic pigments alone or in combination by selecting multiple types depending on the desire. As an addition amount of the pigments, the amount of 2 to 20%, and preferably from 3 to 15% by mass based on the polymer is selected.

When used as the magnetic toner, the aforementioned magnetite can be added. In this case, it is preferable to add the amount of 20 to 60% by mass in the toner in the light of imparting the given magnetic property.

As the organic pigments and the dyes, those conventionally known in the art can be used, and specific organic pigments and dyes are exemplified below.

The pigments for magenta or red include, for example, C.I. pigment red 2, C.I. pigment red 3, C.I. pigment red 5, C.I. pigment red 6, C.I. pigment red 7, C.I. pigment red 15, C.I. pigment red 16, C.I. pigment red 48:1, C.I. pigment red 53:1, C.I. pigment red 57:1, C.I. pigment red 122, C.I. pigment red 123, C.I. pigment red 139, C.I. pigment red 144, C.I. pigment red 149, C.I. pigment red 166, C.I. pigment red 177, C.I. pigment red 178, C.I. pigment red 222 and the like.

The pigments for orange or yellow include, for example, C.I. pigment orange 31, C.I. pigment orange 43, C.I. pigment yellow 12, C.I. pigment yellow 13, C.I. pigment yellow 14, C.I. pigment yellow 15, C.I. pigment yellow 17, C.I. pigment yellow 93, C.I. pigment yellow 94, C.I. pigment yellow 138, C.I. pigment yellow 180, C.I. pigment yellow 185, C.I. pigment yellow 155, C.I. pigment yellow 156, and the like.

The pigments for green or cyan include, for example, C.I. pigment blue 15, C.I. pigment blue 15:2, C.I. pigment blue 15:3, C.I. pigment blue 16, C.I. pigment blue 60, C.I. pigment green 7, and the like.

As the dyes, for example, C.I. solvent red 1, 49, 52, 58, 63, 111 and 122, C.I. solvent yellow 19, 44, 77, 79, 81, 82, 93, 98, 103, 104, 112 and 162, C.I. solvent blue 25, 36, 60, 70, 93 and 95, and the like can be used, and mixtures thereof can be also used.

It is possible to use these organic pigments and dyes alone or in combination by selecting multiple types depending on the desire. The addition amount of the pigments is from 2 to 20%, and preferably from 3 to 15% by mass based on the polymer.

The surface of the coloring agent (coloring agent particles) which composes the toner of the invention may be modified. As a surface modifier, those conventionally known in the art can be used, and specifically silane coupling agents, titanium coupling agents, aluminium coupling agents and the like can be preferably used. The silane coupling agents include, for example, alkoxy silane such as methyltrimethoxysilane, phenyltrimethoxysilane, methylphenyldimethoxysilane and diphenyldimethoxysilane, siloxane such as hexamethyldisiloxane, γ-chloropropyltrimethoxysilane, vinyltrichlorosilane, vinyltrimethoxysilane, vinyltriethoxysilane, γ-methacryloxypropyltrimethoxysilane, γ-glycidoxypropyltrimethoxysilane, γ-mercaptopropyltrimethoxysilane, γ-aminopropyltriethoxysilane, γ-ureidopropyltriethoxysilane, and the like. The titanium coupling agents include, for example, TTS, 9S, 38S, 41B, 46B, 55, 138S, 238S which are commercially available as a brand name of "Plenact" supplied from Ajinomoto Co., Inc., A-1, B-1, TOT, TST, TAA, TAT, TLA, TOG, TBSTA, A-10, TBT, B-2, B-4, B-7, B-10, TBSTA-400, TTS, TOA-30, TSDMA, TTAB, and TTOP which are commercially available articles supplied from Nippon Soda Co., Ltd., and the like. The aluminium coupling agents include, for example, "Plenact AL-M" supplied from Ajinomoto Co., Inc., and the like.

The addition amount of these surface modifiers is preferably from 0.01 to 20%, and more preferably from 0.1 to 5% by mass based on the coloring agent. The method for modifying the surface of coloring agent particles includes the method where the surface modifier is added to the dispersion solution of coloring agent particles and this system is heated to react. The coloring agent particles of which the surface is modified in this way are obtained by collecting via the filtration and repeating the wash and filtration treatments with the same solvent followed by drying.

(Crystalline Compound)

The toner of the invention contains a crystalline compound where a peak top temperature of a maximum endothermic peak is from 70 to 120° C. in an endothermic curve measured by DSC. Since a large plastic effect is obtained by containing the crystalline compound, a fixing property is improved to a large extent. Since such a crystalline compound has low melting viscosity and an action to cause phase separation from a binding resin, it easily exists in the vicinity of toner particle surface. Thus, the crystalline compound has the large plastic effect on the toner particle surface and influences on toner storage stability, toner fluidity, toner fusion, development durability and cleaning stability. When the temperature becomes less than 70° C., blocking resistance and storage stability are reduced whereas when it exceeds 120° C., the great improvement effect on the fixing property can not be anticipated.

When hydrocarbon with iso-paraffin structure or naphthene structure (cycloparaffin structure) which has structurally branched structure(s) or aromatic hydrocarbon are present, the plastic effect becomes larger. Thus, the crystalline compound according to the invention contains 92% or more by mass of hydrocarbon taking normal-paraffin structure which is a straight structure. Therefore, the crystalline compound can improve the fixing property without influencing the storage stability, fluidity, fusion resistance, durable development and cleaning stability. The content of n-paraffin is preferably 93% or more, more preferably 94% or more and especially preferably 95% or more by mass. Thus, the excellent fixing improvement effect is obtained without adverse effect. When it is less than 92% by mass, any of the fluidity, storage stability, fusion resistance and durable development is influenced, and the fixing improvement effect is not sufficiently enjoyed.

In the crystalline compound according to the invention, a half width of the maximum endothermic peak in the endothermic curve measured by DSC is 12° C. or below, and it is possible to keep a balance between the storage stability and the fixing property of the toner. Preferably, this half width is 10° C. or below, and more preferably 8° C. or below. Since the crystalline compound having this half width efficiently exerts the plastic effect, the excellent fixing improvement effect can be obtained by a small addition amount. Reduction of development property and reduction of blocking resistance caused by increasing the addition amount of the crystalline compound, and occurrence of cleaning troubles and drum fusion caused by deterioration of the fluidity are suppressed, and thus, the further fixing improvement can be anticipated by increasing the amount of the crystalline compound component. When the half width exceeds 12° C., either the storage stability or the fixing property is influenced and it becomes difficult to obtain the toner where the storage stability and the fixing property are compatible.

In the endothermic peak measured by DSC, in terms of enhancing these effects, it is preferred that an onset temperature at an initial point is 50° C. or above and an onset temperature at a terminal point is 100° C. or below. When the onset temperature at the initial point is less than 50° C., the storage stability becomes inferior whereas when the onset temperature at the terminal point exceeds 100° C., the fixing improvement effect becomes small.

To exert the effects as the above more intensively, it is preferred that the onset temperature at the initial point is 55° C. or above and the onset temperature at the terminal point is 95° C. or below. More preferably, the onset temperature at the initial point is 60° C. or above and the onset temperature at the terminal point is 90° C. or below.

It is a matter of course that the plastic effect in the invention reduces the melting viscosity of the toner and enhances the fixing property of the toner. Additionally, in the invention, since the plastic effect is larger in the vicinity of the toner surface, the melting viscosity in the vicinity of the toner surface is further reduced to give an anchor effect to a recording medium and thus the plastic effect greatly contributes to the fixing property improvement. On the other hand, since the excessive plastic effect does not occur, the toner which is excellent in blocking resistance and storage stability and is easy to use can be made.

In some conventional toners excellent in low temperature fixing property, when the toner is frictionized by doctor blade on a cleaning blade or slave of a cleaning device, a part has been melted and toner fusion has been caused. In such a case, since the toner of the invention can save the plastic effect to some extent, it is possible to suppress the occurrence of fusion.

Additionally, since the toner of the invention is good in fluidity, movement of the toner in the cleaning device is stabilized. Thus, there is no breakage of the cleaning device due to clogging of the toner in the cleaning device or there is no occurrence of cleaning fault due to an increase of toner retention amount at a special site, and furthermore it is possible to make the toner excellent in fixing property. The movement of toner in a development device and a toner hopper is stabilized, resupply of the toner and mixing of the toner before and after the resupply are good, and thus the stabilization of the development property is brought. This way, since stability in the cleaning and development devices is increased, durable stability in a high speed machine is improved in cooperation with the improvement of fixing property.

As the crystalline compounds used for the invention, the followings can be utilized.

As the crystalline compounds preferably used, there are polyolefin where a low molecular weight byproduct obtained at the polymerization of high molecular weight polyolefin is purified; polyolefin polymerized using a catalyst such as Ziegler catalyst and metallocene catalyst; paraffin wax, Fischer Tropsch wax; synthetic hydrocarbon wax synthesized by Synol method, hydrocol method or Arge method using mineral coal or natural gas as a basic material; synthetic wax using a compound with one carbon as a monomer; hydrocarbon wax having functional groups such as hydroxyl and carboxyl groups; and mixtures of hydrocarbon type wax and hydrocarbon type wax having functional groups.

In these crystalline compounds, those where the molecular weight distribution of these crystalline compounds is made sharp using a pressing sweat method, solvent method, vacuum distillation method, ultracritical gas extraction method, or melt crystallization method and those where low molecular weight solid fatty acid, low molecular weight solid alcohol and the other impurities are eliminated are preferably used.

More preferably used are paraffin wax, Fischer-Tropsch wax, polyethylene synthesized using metallocene catalyst and distillation purified matters of a low molecular byproduct obtained at the polymerization of polyethylene.

In terms of dispersibility, paraffin wax and Fischer-Tropsch wax are especially preferably used, and the remarkable fixing improvement effect is obtained and the development property becomes excellent.

The mean carbon number of n-paraffin is preferably from 30 to 55, more preferably from 32 to 50, and especially by making it from 34 to 45, it is possible to keep a balance in the fixing improvement, storage stability and fluidity. When it is less than 30, the storage stability and fluidity are inferior whereas when it exceeds 55, the fixing improvement effect is reduced.

In the invention, it is possible to make the crystalline compound with high rate of n-paraffin by performing purification and fractional distillation with a high degree of accuracy by utilizing the pressing sweat method, solvent method, recrystallization method, vacuum distillation method, ultracritical gas extraction method, melt crystallization method and the like. Among others, the method of applying the solvent method where the purification is performed using a poor solvent for the crystalline compound is preferable. For example, the solvents such as benzene or toluene and ketone (acetone or methylethylketone); methylisobutylketone; liquefied propane; trichloroethylene and benzene; and dichloroethane and dichloromethane are used.

For example, the following method can be applied. A solvent is added to a basic material crystalline compound and heated to completely dissolve the crystalline compound component, and subsequently cooled by a cooling machine to crystallize the crystalline compound. The crystalline compound is cooled to the given temperature depending on the peak top temperature of the DSC maximum endothermic peak of the aimed crystalline compound, and filtrated. At that time, by strictly performing the temperature control and taking time for a cooling rate, it is possible to separate isoparaffin, naphthene and aromatic matters and increase the n-paraffin percentage. Additionally, a cake of the crystalline compound is washed with the solvent to separate oils, isoparaffin, naphthene and aromatic matters. The n-paraffin percentage can be increased by repeating this. Eventually, the solvent is separated by a solvent collecting apparatus to yield the crystalline compound. Further subsequently, if necessary, hydrogen purification, activated clay treatment and deodorant treatment are carried out. As the basic material crystalline compound, those where the molecular weight distribution has been precedently made narrow using the vacuum distillation, gas extraction or melt crystallization are preferable in terms of increasing the n-paraffin percentage.

Conventionally, in the crystalline compound with low melting point where the peak top temperature of the DSC maximum peak is less than 65° C., it has been possible to increase the n-paraffin percentage even in the conventional solvent method, but for those with 70° C. or above it has been difficult, and especially for those with high melting point of 75° C. or above, it has been difficult. By only the conventional methods such as distillation, the fractional distillation can be performed for the molecular weight, but it has been difficult to sufficiently reduce isoparaffin and naphthene.

As the basic material crystalline compounds preferably used for this solvent method, there are slack wax and paraffin wax obtained from petroleum wax, polymerization byproducts obtained at the ethylene polymerization, low molecular weigh polyethylene polymerized using metallocene as a catalyst, Fischer-Tropsch wax obtained using mineral coal and natural gas as a basic material.

In the crystalline compound of the invention, a kinetic viscosity at 100° C. measured by JIS K 2283-3.8 is preferably 20 $mm^2/S$ or less, and more preferably at 1 to 10 $mm^2/S$ or less, at which the preferable plastic effect is obtained.

In the crystalline compound of the invention, a penetration at 25° C. measured by JIS K 2235-5.4 is 4 or less, and more preferably at 3 or less, at which the excessive plastic effect can be prevented.

In the toner of the invention, the content of these crystalline compounds is from 0.2 to 20 parts by mass based on 100 parts by mass of the binding resin, and among others, it is effective to use at 0.5 to 10 parts by mass.

In the DSC measurement in the invention, for example, DSC-7 supplied from Perkin Elmer Inc. can be utilized.

The measurement method is performed according to ASTM D3418-82. As the DSC curve used for the invention, the DSC curve measured when the temperature is cooled and raised at a temperature speed of 10° C./min after taking a previous work experience by heating the temperature once is used. Respective temperatures are defined as follows.

Peak top temperature of maximum endothermic peak

A peak top temperature of the peak where the height from a baseline is highest.

Half width of the maximum endothermic peak

A peak temperature width at a half height of a height from the baseline to the peak top, of the maximum endothermic peak Initial point onset temperature of the endothermic peak A temperature of an intersecting point of a tangent line of a curve at a point where a differential value of the curve at the temperature rising is maximum and the baseline Terminal point onset temperature of the endothermic peak A temperature of an intersecting point of a tangent line of a curve at a point where a differential value of the curve at the temperature rising is minimum and the baseline.

The content of n-paraffin can be calculated from quantitative analysis of gas chromatograph. For example, GC-17A supplied from Shimadzu Corporation can be utilized, and a column where a liquid phase is dimethylsiloxane, a membrane thickness is 0.25 μm and internal diameter×length=0.22 mm×15 m is used, and FID is used as a detector.

In a measurement condition, helium is used as a carrier gas. For a temperature condition, in a column incubator, an initial temperature is 60° C., then temperature rising is performed at 40° C./min up to 160° C., subsequently the temperature rising is performed at 15° C./min up to 350° C., then the temperature rising is performed at 7° C./min up to 445° C., and the temperature is held for 4 min. In a vaporization room, an initial temperature is 70° C., the temperature rising is performed at 250° C./min up to 445° C., and the temperature is held for 1 min. The detector is held at 445° C. For a sample, heptane is used as a solvent, and the concentration is adjusted to 0.1% by mass.

As standard substances, n-paraffins with carbon number 20, 24, 28, 30, 32, 36, 40 and 44 are used. A peak area of the n-paraffin with each carbon number is calculated by interpolation and extrapolation of retention time. This can calculate respective contents in the whole sample by each content of each carbon number, and represent by % by mass. The other peaks between respective normal components are regarded as non-normal components (e.g., isoparaffin). The n-paraffin percentage is the content of n-paraffin in the whole sample components, is displayed as % by mass, and corresponds to an area percentage of the n-paraffin component in all peak areas.

The mean carbon number is calculated from the following formula by mass average in the distribution of n-paraffin.

$$\text{Mean carbon number } C=(1/100)\times\Sigma Ci\cdot Fi$$

Where Ci represents the carbon number, and Fi represents the percentage of the content of carbon number Ci.

A standard deviation S of the carbon number distribution of n-paraffin is preferably from 0.5 to 10, more preferably from 1.0 to 8.0, and still preferably at 1.5 to 6.0, the plastic effect which keeps a balance is obtained. The n-paraffins where the standard deviation is less than 0.5, especially those close to a pure paraffin where a component is a single becomes high in crystallinity and becomes difficult to finely disperse in the toner. When the standard deviation exceeds 10, the plastic effect becomes large, which influences on blocking resistance.

Further in the invention, the hydrocarbon wax where the content is continuously changed along with the increase and decrease of the carbon number (aspect where a size of the content is not changed every carbon number, and the content changes smoothly along with the increase and decrease of the carbon number) is preferable. It can highly realize hardness at ambient temperature and low viscosity at melting simultaneously, and make the excellent storage stability, powder property and fixing property compatible.

In the invention, to compensate a mold release action, the other crystalline compound may be combined. In these combined crystalline compounds, the peak top temperature of the maximum endothermic peak is preferably form 90 to 150° C. For example, the following crystalline compounds are included. There are waxes such as montan wax and derivative thereof, microcrystalline wax and derivatives thereof, Fischer-Tropsch wax and derivative thereof, polyolefin wax and derivative thereof, carnauba wax and derivative thereof, and the derivatives comprise oxides, block copolymers with vinyl type monomer and graft modified matters. Additionally, there are also alcohol wax, fatty acid wax, acid amide wax, ester wax, ketone wax, cured ricinus and derivative thereof, plant type wax, animal type wax, mineral wax and petrolatum.

Among others, the crystalline compounds preferably used and combined are low molecular polyolefin obtained by radical polymerization of olefin under high pressure or polymerizing it using Ziegler catalyst/metallocene catalyst, and a byproduct at that time; residue on distillation of hydrocarbon obtained using a catalyst from synthetic gas made up of low molecular weight polyolefin, carbon monoxide and hydrogen obtained by thermolysis of high molecular weight polyolefin; or crystalline compounds obtained from synthetic hydrocarbon obtained by hydrogenating these, and anti-oxidant may be added. Or there are also linear alcohol wax, fatty acid wax, acid amide wax, ester wax, or montan type derivatives. Also those where impurities such as fatty acid have been precedently removed are preferable.

The combined crystalline compounds where wax is sorted by molecular weight from these waxes utilizing a pressing sweat method, solvent method, vacuum distillation, ultracritical gas extraction, sorting crystallization (e.g., melt crystallization and crystal filtration) and the like are also preferably used. After sorting, oxidation, block copolymerization and graft modification may be carried out.

The content of these combined crystalline compounds can be used at 0.5 to 20 parts by mass as a total together with the aforementioned crystalline compound based on 100 parts by mass of the binding resin, and preferably it is effective to use at 1.0 to 15 part by mass.

(Developer)

The toner of the invention may be used as a one component developer or a two component developer. When used as the one component developer, a non-magnetic one component developer or a magnetic one component developer where magnetic particles of about 0.1 to 0.5 μm are contained in the toner is included, and both can be used.

Also, it is possible to use as the two component developer by mixing a carrier. In this case, as magnetic particles of the carrier, it is possible to use materials conventionally known in the art, such as metals such as iron, ferrite and magnetite, alloys of those metals with metals such as aluminium and lead. Especially, ferrite particle is preferable. For the above magnetic particles, the volume mean particle size thereof is from 15 to 100 μm, and more preferably from 25 to 80 μm.

The volume mean particle size of the carrier can be measured by a laser diffraction type particle size distribution measurement apparatus comprising a wet type dispersing machine, "Helos" (supplied from Sympatec GmbH) as a representative.

As the carrier, those where the magnetic particles are further coated with a resin or so-called resin dispersion type carriers where the magnetic particles are dispersed in the resin are preferable. A resin composition for coating is not especially limited, and for example, olefin type resins, styrene type resins, styrene-acryl type resins, silicone type resins, ester type resins, or fluorine-containing polymer type resins or the like are used. A resin for composing the resin dispersion type carrier is not especially limited, those known in the art can be used, and, for example, it is possible to use styrene-acryl type resins, polyester resins, fluorine type resins, phenol resins and the like.

In these resins, especially fluorine-containing polymer type resins are preferable, and among others, fluorinated arylate resins are preferable. For example, resins where esterified reaction matter of 1,1-dihydroperfluoroalcohol or trihydroperfluoroalcohol, tetrahydroperfluoroalcohol, other fluoroalcohol, fluoroacetylalcohol, or N-fluoroalkylsulfonyl-N-alkylaminoalcohol with acrylic acid or methacrylic acid (e.g., 1,1,1-trifluoroehtyl methacrylate) is polymerized, or copolymer resins of these with aliphatic olefin, halogenated aliphatic olefin, conjugate diene type aliphatic diolefin, aromatic vinyl type compounds, nitrogen-containing vinyl type compounds, and (meth)acrylate alkyl ester are included.

(Method for Forming Images and Image Forming Apparatus)

Next, an image forming apparatus used for an image forming method using the toner of the invention is illustrated.

Figure 2:
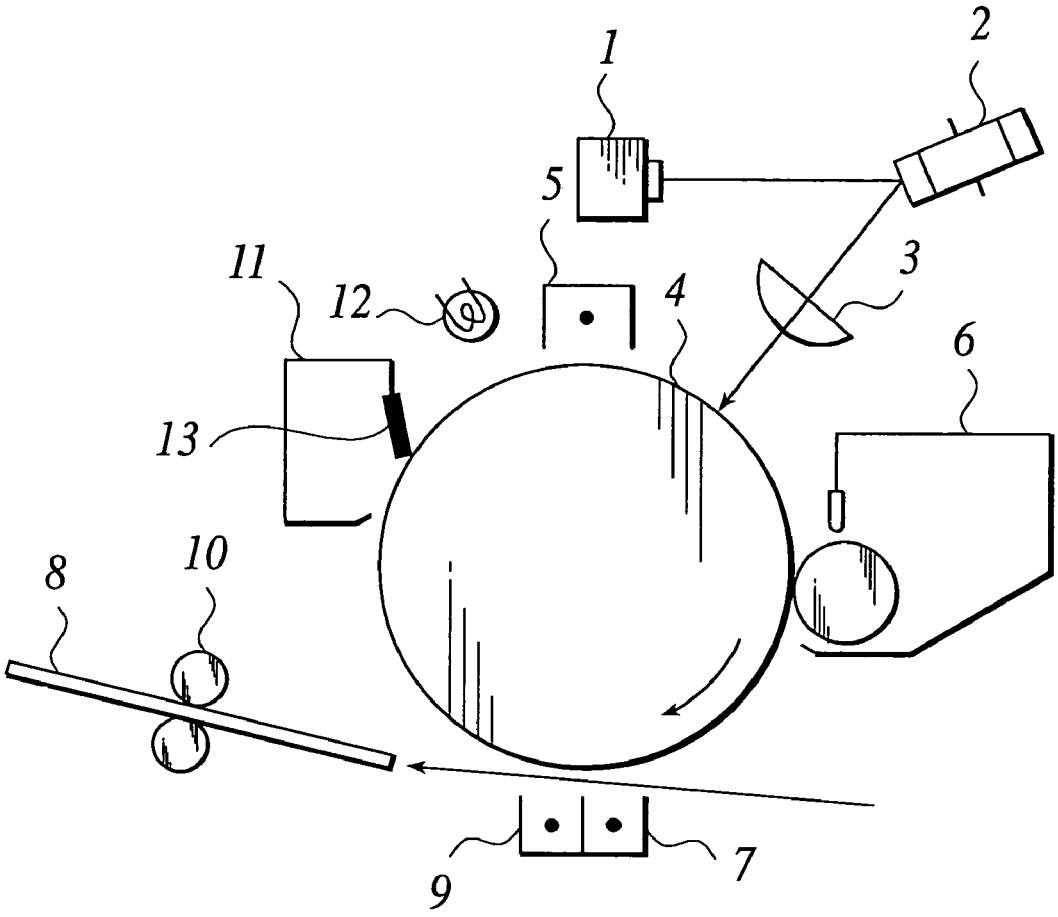
FIG. 2 is a sectional block diagram showing one example of an image forming apparatus applied to the invention.

FIG. 2 is a sectional block diagram showing one example of the image forming apparatus of the invention. 4 is a photoconductor drum which is a latent image forming body, is made by forming an organic photo conductive body (OPC) which is a photoconductor layer on a peripheral face of a drum base substance made of aluminium, and rotates in an arrow direction at the given speed.

In FIG. 2, based on information read out at a document reading out unit which is not shown in the figure, exposure light is emitted from a semiconductor laser light source 1. An electrostatic latent image is made by allocating this via a polygon mirror 2 to a vertical direction for a paper face in FIG. 2 and irradiating on a photoconductor face through fθ lens 3 which compensates distortion of the image. The photoconductor drum 4 has been precedently charged uniformly by a charging unit 5, and has started rotating in clockwise in conformity with a timing of picture exposure.

The electrostatic latent image on the photoconductor drum face is developed with the toner by a development unit 6, and a formed toner picture is transferred on transfer paper 8 fed in conformity with a timing by an action of a transfer unit 7. Further, the photoconductor drum 4 and the transfer paper 8 are separated by a separation unit (separation pole) 9, but the toner picture is transferred/supported on the transfer paper 8, led to a fixing unit (fixing device) 10 and fixed.

Untransferred toner and the like left on the photoconductor face are cleaned by a cleaning unit 11 of a cleaning blade mode, residual charge is eliminated at a pre-charging exposure light (PCL) 12, and the toner is uniformly charged again by the charging unit 5 for next image formation.

When toner recycle is performed, it is not especially limited. For example, the method where the toner collected at the cleaning section is carried via a feeding conveyer or feeding screw to a toner hopper for resupply, mixed with the toner for the development device or resupply in an intermediate chamber, and supplied into the development device can be included. Preferably, the method where the toner is directly returned to the development device or the method where the toner for resupply and the toner for recycle are mixed in the intermediate chamber and supplied can be included.

Figure 3:
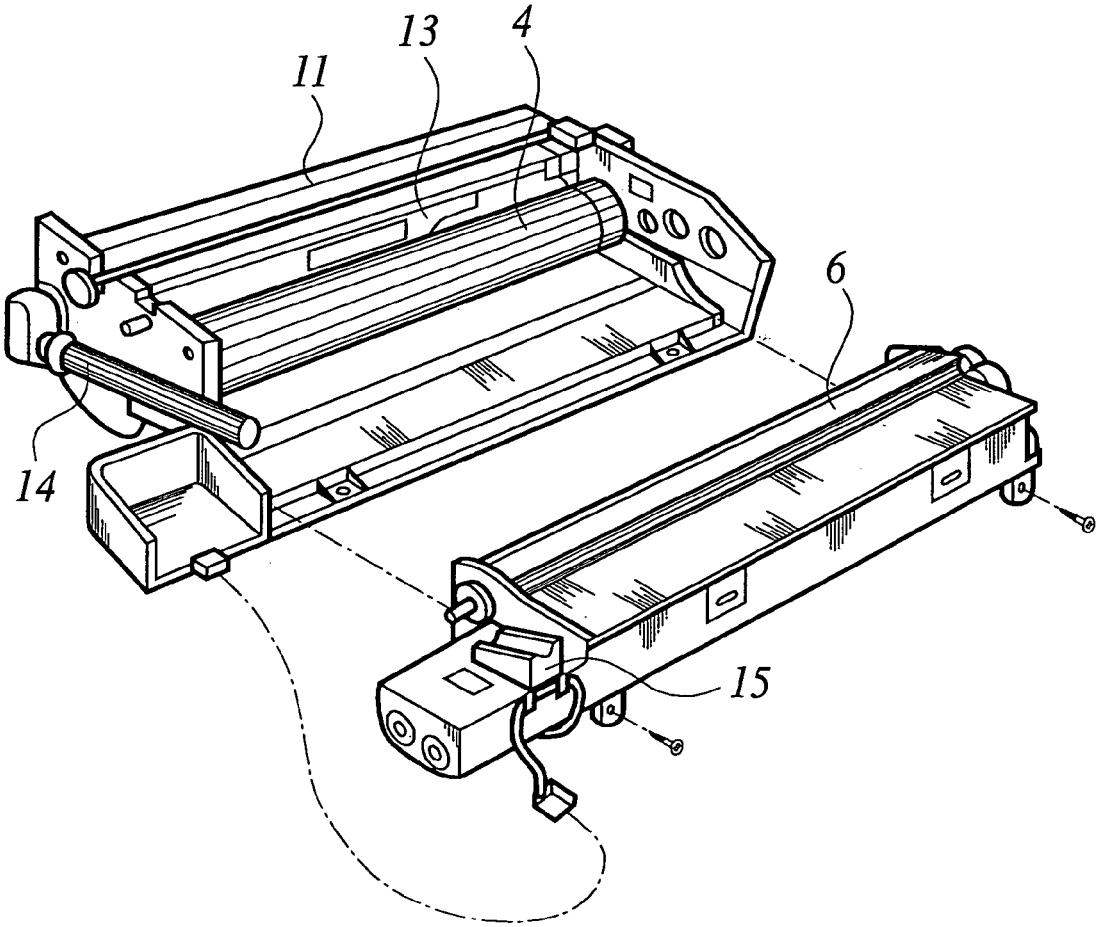
FIG. 3 is a perspective block diagram of recycle members of toner.

Next, in FIG. 3, one example of a perspective block diagram of recycle members of the toner is included. In this mode, the recycle toner is directly returned to the development device.

The untransferred toner retrieved at a cleaning blade 13 is collected to a toner recycle pipe 14 by a feeding screw in a toner cleaning device 11, further returned from a socket 15 of this recycle pipe to a development device 6, and used again as a developer.

FIG. 3 is also a perspective view of a process cartridge attached removably to the image forming apparatus of the invention. In FIG. 3, in order to easily understand a perspective structure, a photoconductor unit and a developer unit are removed. But these can be integrated and removably loaded to the image forming apparatus. In this case, the photoconductor, development device, cleaning device and recycle members are integrated and compose the process cartridge.

The above image forming apparatus can be also made into a form which loads the process cartridge comprising the photoconductor drum and at least one of the charging device, development device, cleaning device or recycle members.

Next, the transfer paper is representatively plain paper, but is not especially limited so long as unfixed picture after the development can be transferred on it, and PET base for OHP and the like are of course included.

A rubber-like elastic body with a thickness of about 1 to 30 mm is used for the cleaning blade 13, and urethane rubber is most frequently used as quality of material. Since this is used by contacting the photoconductor with pressure, heat is easily conducted. In the invention, it is desirable that a cancellation mechanism is installed to separate it from the photoconductor when image forming operation is not performed.

The invention can be also used for an image forming apparatus by electrophotography, especially an apparatus for forming an electrostatic latent image on a photoconductor by modulation beams modulated with digital image data from a computer and the like.

In these year, in the field of electrophotographs where the electrostatic latent image is formed on the photoconductor and this latent image is developed to obtain a visual image, research and development have been actively performed on methods for forming images employing digital modes capable of forming the images with high quality where improvement of picture quality, conversion and edition are easy.

There is an apparatus where as a scanning optical system which is optically modulated by digital image signals from a computer or a copy document employed for this image forming method or apparatus, a laser optical system is mediated by an optoacoustic modulator, and using a semiconductor laser, an apparatus which is optically modulated by the optoacoustic modulator, a laser intensity is directly modulated. A dot-shaped image is formed by performing a spot exposure on a uniformly charged photoconductor from these scanning optical systems.

The beam irradiated from the aforementioned scanning optical system has a circular or elliptical luminance distribution approximating a normal distribution of which bottoms extend to right and left. For example, in the case of laser beam, typically the beam is extremely narrow circular or elliptical where both or either a major scanning direction and/or a minor scanning direction on the photoconductor is from 20 to 100 μm.

The toner of the invention is suitably used for the image forming method comprising fixing by passing an image formation support on which a toner picture is formed between a heating roller and a pressing roller which compose the fixing unit.

Figure 4:
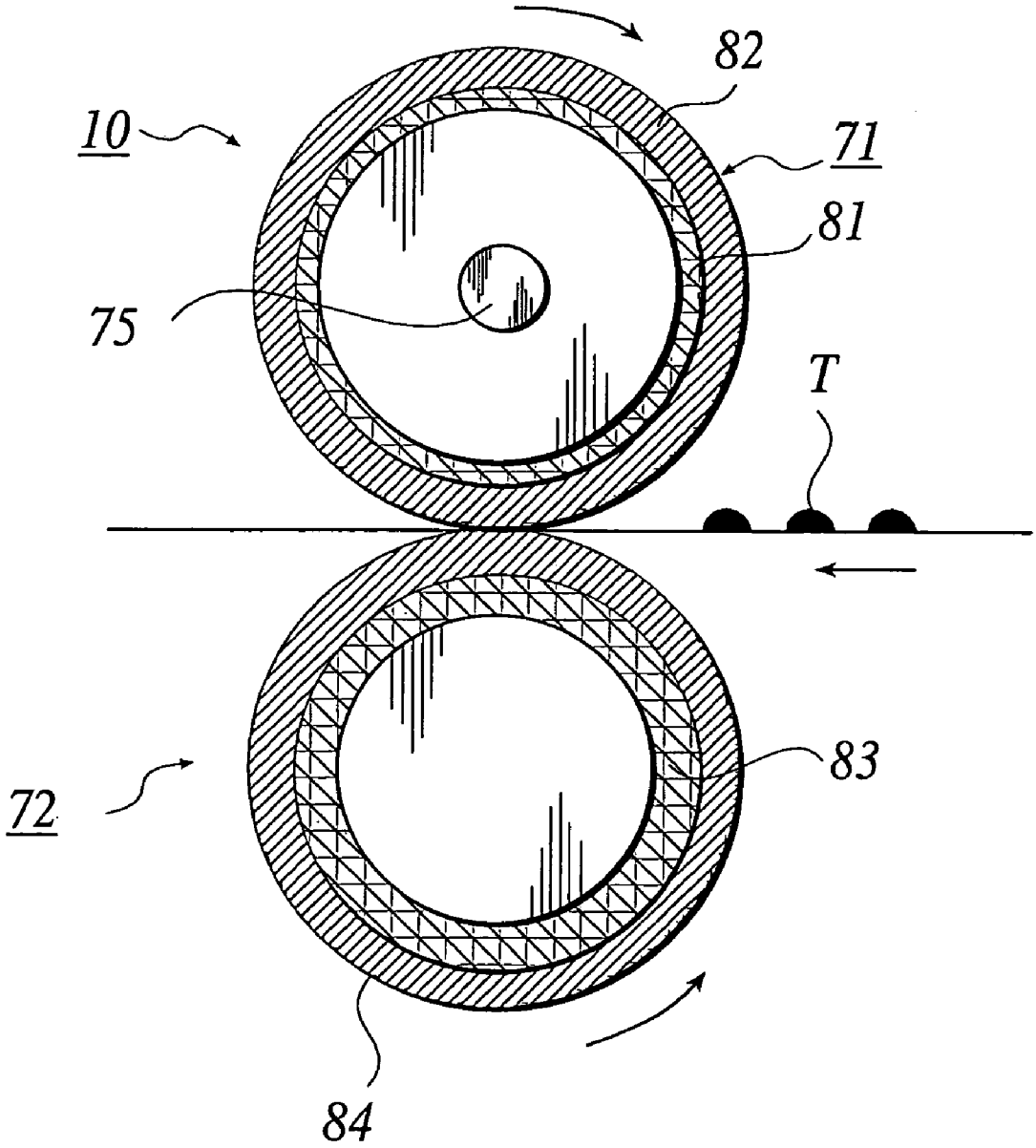
FIG. 4 is a sectional view of a fixing unit applied to the invention.

FIG. 4 is a sectional view showing one example of a fixing unit in the method for forming images using the toner of the invention. The fixing unit 10 shown in FIG. 4 comprises a heating roller 71 and a pressing roller 72 which abuts thereto. In FIG. 4, T is a toner picture formed on transfer paper (image support).

The heating roller 71 is made by forming a coating layer 82 made up of a fluorine resin or an elastic body on the surface of a core grid 81, and encloses a heating member 75 made up of a linear heater.

The core grid 81 is composed of a metal, and an internal diameter thereof is from 10 to 70 mm. Metals which compose the core grid 81 are not especially limited, and can include, for example, metals such as iron, aluminium and copper, or alloys thereof.

A wall thickness of the core grid 81 is from 0.1 to 15 mm, and is determined in consideration of a balance between request of energy saving (making thin) and strength (depending on constituent materials). For example, when the core grid made up of aluminium retains the same strength as that of the core grid made up of iron with a thickness of 0.57 mm, the wall thickness thereof is required to be 0.8 mm.

As the fluorine resin which composes the coating layer 82, PTFE (polytetrafluoroethylene) and PFA (tetrafluoroethylene-perfluoroalkylvinylether copolymer) and the like can be exemplified.

A thickness of the coating layer 82 made up of the fluorine resin is from 10 to 500 μm, and preferably from 20 to 400 μm.

When the thickness of the coating layer 82 made up of the fluorine resin is less than 10 μm, a function as the coating layer can not be sufficiently exerted and it is not possible to assure durability as the fixing unit. Meanwhile, the surface of the coating layer of which thickness exceeds 500 μm is easily scratched with paper powder, the toner adheres to the scratched part, and there is a problem that image stain occurs due to this.

As the elastic body which composes the coating layer 82, it is preferable to use silicone rubbers and silicone sponge rubbers such as LTV, RTV and HTV with good heat resistance.

Asker C hardness of the elastic body which composes the coating layer 82 is less than 80°, preferably less than 60°.

A thickness of the coating layer 82 made up of the elastic body is from 0.1 to 30 mm and preferably from 0.1 to 20 mm.

When the Asker C hardness of the elastic body which composes the coating layer 82 is more than 80°, and when the thickness of the coating layer 82 is less than 0.1 mm, a nip at fixing can not be enlarged and an effect of soft fixing (e.g., improvement effect of color reproducibility by a toner layer of a smoothened interface) can not be exerted.

As the heating member 75, a halogen heater can be suitably used. The pressing roller 72 is made by forming a coating layer 84 made up of an elastic body on the surface on a core grid 83. Elastic bodies which compose the coating layer 84 are not especially limited, and can include various soft rubbers such as urethane rubber and silicone rubber, and sponge rubber. It is preferable to use silicone rubber and silicone sponge rubber exemplified as those which compose the coating layer 84.

Asker C hardness of the elastic body which composes the coating layer 84 is less than 80°, preferably less than 70° and more preferably less than 60°.

A thickness of the coating layer 84 is from 0.1 to 30 mm and preferably from 0.1 to 20 mm.

When the Asker C hardness of the elastic body which composes the coating layer 84 is more than 80°, and when the thickness of the coating layer 84 is less than 0.1 mm, the nip at fixing can not be enlarged and the effect of soft fixing can not be exerted.

Materials which compose the core grid 83 are not especially limited, and can include, for example, metals such as aluminium, iron and copper, or alloys thereof.

An abutting load (total load) of the heating roller 71 and the pressing roller 72 is typically from 40 to 350 N, preferably from 50 to 300 N and more preferably from 50 to 250 N. This abutting load is defined in consideration of strength of the heating roller 71 (wall thickness of core grid 81), and for example, in the heating roller having the core grid made up of iron of 0.3 mm, it is preferable to be 250 N or less.

In the light of offset resistance and fixing property, a nip width is preferably from 4 to 10 mm, and a bearing of the nip is preferably from $0.6\times10^5$ Pa to $1.5\times10^5$ Pa.

Showing one example of the fixing condition by the fixing unit shown in FIG. 4, a fixing temperature (surface temperature of the heating roller) is from 150 to 210° C., and a fixing line speed is from 230 to 900 mm/sec.

EXAMPLES

Hereinafter, the present invention is described by referring to examples, but the aspects of the invention is not limited thereto. "Parts" in context represent "parts by mass".

[1] Preparation of Crystalline Compound Crystalline Compounds 1 to 4

The crystalline compounds 1 to 4 were obtained by distilling in vacuum commercially available Fischer-Tropsch wax using natural gas as a basic material, obtaining ones from different fraction of distillate by changing a distillation condition, washing with methylbutylketone in a dissolved state, and gradually cooling.

Crystalline Compounds 5 and 6

Using polyethylene obtained under metallocene as a catalyst as a basic material, the crystalline compounds 5 to 6 were obtained by washing as is the case with the crystalline compounds 1 to 4.

Crystalline Compound 7

Using a mix solvent of toluene and methylethylketone for the solvent, a basic material wax was dissolved at 80° C., cooled to 68° C. at 0.2° C./min, retained for one hour, and subsequently filtrated. The wax filtered off was washed twice with the new mix solvent, subsequently the wax was taken out, and the solvent was separated by a solvent collection apparatus, and hydrogenation purification was performed to yield the crystalline compound 7.

Crystalline Compounds 8

Using xylene for a solvent, a basic material wax was dissolved at 134° C., cooled to 98° C. at 0.2° C./min, retained for one hour, and subsequently filtrated. The wax filtered off was washed twice with the new mix solvent, subsequently the wax was taken out, and the solvent was separated by a solvent collection apparatus, and hydrogenation purification was performed to yield the crystalline compound 8.

Properties of the crystalline compounds 1 to 8 are shown in the following Table 1.

TABLE 1

| CRYSTALLINE COMPOUND NO. | HOST WAX | CONTENT OF N-PARAFFIN (% by mass) | MEAN NUMBER OF CARBONS {c} | STANDARD DEVIATION {s} | MAXIMUM ENDOTHERMIC PEAK: PEAK TOP TEMPERATURE (° C.) | MAXIMUM ENDOTHERMIC PEAK: HALF WIDTH (° C.) | PENETRATION |
|---|---|---|---|---|---|---|---|
| 1 | FISCHER-TROPSCH | 97.6 | 35.4 | 4.1 | 72.1 | 5.7 | 2 |
| 2 | FISCHER-TROPSCH | 96.7 | 42.3 | 5.4 | 77.6 | 7.9 | 2 |
| 3 | FISCHER-TROPSCH | 95.6 | 48.7 | 6.2 | 83.2 | 8.6 | 1 |
| 4 | FISCHER-TROPSCH | 92.4 | 53.4 | 6.4 | 105.4 | 11.1 | 1 |
| 5 | POLYETHYLENE | 98.4 | 58.6 | 4.3 | 110.2 | 7.8 | 0 |
| 6 | POLYETHYLENE | 97.6 | 65.4 | 5.1 | 118.2 | 9.4 | 0 |
| 7 | PARAFFIN | 90.2 | 29.6 | 2.4 | 64.2 | 4.1 | 5 |
| 8 | PARAFFIN | 91.1 | 77.2 | 9.4 | 122.4 | 14.2 | 0 |

[2] Preparation of Crystalline Compound Dispersion Solution

Crystalline Compound Dispersion Solution 1

| | |
|---|---|
| Crystalline compound 1 | 50 parts by mass |
| Anionic surfactant (Neogen SC, supplied from Daiichi Kogyo Seiyaku Co., Ltd.) | 5 parts by mass |
| Ion-exchange water | 200 parts by mass |

The above ingredients were heated at 96° C., dispersed using a homogenizer (Untra-Turrax T50 supplied from IKA Works Inc.), and subsequently treated with dispersion by a pressure jetting type homogenizer to yield the crystalline compound dispersion solution 1.

Crystalline Compound Dispersion Solutions 2 to 8

The crystalline compound dispersion solutions 2 to 8 were obtained as is the case with the crystalline compound dispersion solution 1, except that the crystalline compound 1 was changed to the crystalline compound 2 to 8.

[3] Preparation of Resin for Toner

[Latex 1HML]

(1) Preparation of Nuclear Particles (First-stage Polymerization)

Into a 5000 ml separable flask equipped with a stirring unit, a thermal sensor, a cooling tube and a nitrogen introducing unit, a surfactant solution (aqueous vehicle) where 7.08 g of an anionic surfactant (101), $C_{10}H_{21}(OCH_2CH_2)_2OSO_3Na$ was dissolved in 3010 g of ion-exchange water was placed, and the temperature in the flask was raised to 80° C. with stirring at a stirring speed of 230 rpm under a nitrogen gas flow.

An initiator solution where 9.2 g of a polymerization initiator (potassium persulfate: KPS) was dissolved in 200 g of ion-exchange water was added to this surfactant solution, and the temperature was made 75° C., subsequently, a monomer mixture solution made up of 70.1 g of styrene, 19.9 g of n-butyl acrylate and 10.9 g of methacrylic acid was dripped over one hour, and the polymerization (first-stage polymerization) was performed by heating/stirring this system at 75° C. over two hours to prepare latex (dispersion solution of resin particles made up of a high molecular weight resin). This is rendered "latex (1H)".

(2) Formation of Intermediate Layer (Second-stage Polymerization)

In a flask equipped with a stirring unit, a monomer mixture solution made up of 105.6 g of styrene, 30.0 g of n-butyl acrylate, 6.2 g of methacrylic acid and 5.6 g of n-octyl-3-mercaptopropionate ester was heated to 90° C. and dissolved to prepare a monomer solution.

Meanwhile, a surfactant solution where 1.6 g of the anionic surfactant (the above formula (101)) was dissolved in 2700 ml of ion-exchange water was heated to 98° C., 28 g in terms of solid content of the above latex (1H) which was a dispersion solution of nuclear particles was added to this surfactant solution, and subsequently a dispersion solution (emulsion) comprising emulsified particles (oil droplets) was prepared by a mechanical dispersing machine having a circulation path, "Clearmix" (supplied from M Technique Co., Ltd.).

Then, an initiator solution where 5.1 g of a polymerization initiator (KPS) was dissolved in 240 ml of ion-exchange water and 750 ml of ion-exchange water were added to this dispersion solution (emulsion), and the polymerization (second stage polymerization) was performed by heating/stirring this system at 98° C. over 12 hours to yield latex (dispersion solution of composite resin particles with a structure where the surface of the resin particles made up of the high molecular weight resin is coated with an intermediate molecular weight resin). This is rendered "latex (1HM)".

(3) Formation of Outer Layer (Third Stage Polymerization)

To the latex (1HM) obtained as the above, an initiator solution where 7.4 g of a polymerization initiator (KPS) was dissolved in 200 ml of ion-exchange water was added, and under a temperature condition at 80° C., a monomer mixture solution made up of 300 g of styrene, 95 g of n-butyl acrylate, 15.3 g of methacrylic acid and 10.4 g of n-octyl-3-mercaptopropionate ester was dripped over one hour. After the termination of dripping, the polymerization (third stage polymerization) was performed by heating/stirring over two hours, and the reaction was cooled to 28° C. to yield latex (dispersion solution of composite resin particles having a midmost made up of the high molecular weight resin, an intermediate layer made up of the intermediate molecular weight resin and an outer layer made up to the low molecular weight resin).

This latex is rendered "latex (1HML)".

The composite resin particles which compose this latex (1HML) have peak molecular weights at 138,000, 80,000 and 13,000. A weight mean particle size of these composite resin particles was 122 nm.

[Latex 2HML]

Latex (dispersion solution of composite resin particles having a midmost made up of the high molecular weight resin, an intermediate layer made up of the intermediate molecular weight resin and an outer layer made up to the low molecular weight resin) was obtained as is the case with the latex (1HML), except that 7.08 g of anionic surfactant (sodium dodecylbenzenesulfonate: SDS) was used in place of the surfactant (101). This latex is rendered "latex (2HML)".

The composite resin particles which compose this latex (2HML) have peak molecular weights at 138,000, 80,000 and 12,000. A weight mean particle size of these composite resin particles was 110 nm.

[Manufacture of Colored Particles 1 to 10 and Colored Particles for Comparison 1 to 6]

The anionic surfactant (101) (59.0 g) was dissolved in 1600 ml of ion-exchange water with stirring. As this solution was stirred, 420.0 g of carbon black, "Regal 330" (supplied from Cabot Corporation) was gradually added, and then dispersion treatment was performed using "Clearmix" (supplied from M Technique Co., Ltd.) to prepare a dispersion solution of coloring agent particles (hereinafter, referred to as "coloring agent dispersion solution 1"). When particle diameters of the coloring agent particles in this coloring agent dispersion solution were measured using an electrophoretic light scattering spectrophotometer, "ELS-800" (supplied from Otsuka Electronics Co., Ltd.), the weight mean particle size was 89 nm.

The latex (1HML) (420.7 g in terms of solid content), 900 g of ion-exchange water, 166 g of the coloring agent dispersion solution 1, and 210 g of each of the crystalline compound dispersion solutions 1 to 8 in combination in Table 2 were placed and stirred in a reaction container (four-necked flask) equipped with a temperature sensor, a cooling tube, a nitrogen introducing unit and a stirring unit. After adjusting an internal temperature of the container to 30° C., an aqueous solution of sodium hydroxide at 5 mol/L was added to this solution to adjust pH to 8 to 10.0.

Then, an aqueous solution where 12.1 g of magnesium chloride 6-hydrate was dissolved in 1000 ml of ion-exchange water was added over 10 min at 30° C. under stirring. After leaving for 3 min, temperature rising was started, and this system was heated to 90° C. over 6 to 60 min to perform production of associated particles. In that state, particle sizes of associated particles were measured by "Coulter Counter TA-II". At the time point when the number mean particle size became 4 to 7 μm, particle growth was stopped by adding an aqueous solution where 80.4 g of sodium chloride was dissolved in 1000 ml of ion-exchange water, and further the fusion of particles and the phase separation of crystalline compound were continued by heating/stirring at a solution temperature of 85 to 98° C. over 2 to 12 hours as a maturation treatment (maturation).

Thereafter, the solution was cooled to 30° C., pH was adjusted to 2.0 by adding hydrochloric acid, and the stirring was stopped. The colored particles were obtained by filtrating the produced associated particles, repeatedly washing with ion-exchange water at 45° C., and subsequently drying with warm wind at 40° C.

With respect to the colored particles 1 to 10 and the colored particles for comparison 1 to 6, the properties such as mean values of distance between the most proximal walls and percentages (% by number) having islands where the distance between the most proximal walls is 1300 nm or more as shown in Table 2 were obtained by controlling dispersion states, shapes and variation coefficients of shape coefficients of the crystalline compound and the coloring agent by controlling pH at the aggregating, temperature, maturation time period and stirring strength at the maturation, and further by optionally adjusting the toner particle sizes and the variation coefficient of particle size distribution by sorting in the solution (these were shown as examples 1 to 10 and comparative examples 1 to 6, respectively).

TABLE 2

| | CRYSTALLINE COMPOUND NO. | MEAN VALUE OF DISTANCE BETWEEN THE MOST PROXIMAL WALLS (nm) | ISLANDS WHERE DISTANCE BETWEEN THE MOST PROXIMAL WALLS IS 1300 nm OR MORE (%) | PERCENTAGE OF TONER PARTICLES WHERE NO ISLAND IS EXPOSED (%) |
|---|---|---|---|---|
| EXAMPLE 1 | 1 | 396 | 0.7 | 99.9 |
| EXAMPLE 2 | 2 | 389 | 2.4 | 99.4 |
| EXAMPLE 3 | 3 | 577 | 3.9 | 99.7 |
| EXAMPLE 4 | 4 | 281 | 1.4 | 99.7 |
| EXAMPLE 5 | 5 | 613 | 2.1 | 98.7 |
| EXAMPLE 6 | 6 | 631 | 3.9 | 98.4 |
| EXAMPLE 7 | 1 | 795 | 2.3 | 97.4 |

TABLE 2-continued

| | CRYSTALLINE COMPOUND NO. | MEAN VALUE OF DISTANCE BETWEEN THE MOST PROXIMAL WALLS (nm) | ISLANDS WHERE DISTANCE BETWEEN THE MOST PROXIMAL WALLS IS 1300 nm OR MORE (%) | PERCENTAGE OF TONER PARTICLES WHERE NO ISLAND IS EXPOSED (%) |
|---|---|---|---|---|
| EXAMPLE 8 | 1 | 1044 | 1.9 | 99.4 |
| EXAMPLE 9 | 1 | 118 | 2.3 | 99.1 |
| EXAMPLE 10 | 1 | 465 | 9.7 | 98.4 |
| COMPARATIVE EXAMPLE 1 | 1 | 1084 | 2.5 | 89.1 |
| COMPARATIVE EXAMPLE 2 | 1 | 84 | 2.1 | 84.5 |
| COMPARATIVE EXAMPLE 3 | 1 | 573 | 18.4 | 91.2 |
| COMPARATIVE EXAMPLE 4 | 1 | 1098 | 12.4 | 94.6 |
| COMPARATIVE EXAMPLE 5 | 7 | 573 | 3.4 | 99.3 |
| COMPARATIVE EXAMPLE 6 | 8 | 573 | 1.9 | 98.1 |

To the colored particles 1 to 10 and the colored particles for comparison 1 to 6 obtained as the above, 0.8 parts by mass of hydrophobic silica with a mean primary particle size of 35 nm and 1.0 part by mass of hydrophobic titanium oxide with a mean primary particle size of 25 nm were added, and mixed for 25 min by setting rotary wings of Henschel mixer at 30 m/s. With respect to these colored particles, their shapes and particle sizes are not changed by the addition of external additives.

Manufacture of Carrier

Manufacture of Ferrite Core Material

18 Mol % of MnO, 4 mol % of MgO and 78 mol % of $Fe_2O_3$ were pulverized for 2 hours by a wet type ball mill, mixed/dried, subsequently calcinated by retaining at 900° C. for 2 hours, and this was pulverized by a ball mill for 3 hours to make slurry. A dispersant and a binder were added, granulated/dried by a spray dryer, and subsequently firing at 1200° C. for 3 hours was performed to yield ferrite core material particles with a resistance value of $4.3\times10^8$ Ω·cm.

Manufacture of Resin for Coating

First, copolymer of 1,1,1-trifluoroethyl methacrylate/methyl methacrylate (copolymerization ratio 2/8) was synthesized by emulsion polymerization where a concentration in an aqueous solution vehicle is 0.3% by mass using sodium benzenesulfonate having alkyl group with 12 carbons as a surfactant, and resin fine particles with a volume mean primary particle size of 0.1 μm, a weight mean molecular weight (Mw) of 200,000, a number mean molecular weight (Mn) of 91,000, Mw/Mn=2.2, a softening point temperature (Tsp) at 230° C. and a glass transition temperature (Tg) at 110° C. were obtained. The resin fine particles were azeotroped with water in an emulsified state to make a residual monomer amount 510 ppm.

Next, 100 parts by mass of the ferrite core material particles and 2 parts by mass of the resin fine particles were placed in a high speed agitating mixer with agitation blades, and agitated/mixed at 120° C. for 30 min to yield a resin-coated carrier with a volume mean particle size of 61 μm by taking advantage of mechanical impact strength.

Manufacture of Developer

Each colored particle to which external additives were added and the carrier were mixed to prepare a developer where a toner concentration is 6% by mass.

Manufacture of Photoconductor P1

The following coating solutions were applied on a cylindrical conductive support with a length of 380 mm and a diameter of 60 mm to make a photoconductor P1.

<Undercoating Layer>

| | |
|---|---|
| Titanium chelate compound (TC-750, supplied from Matsumoto Chemical Industry Co., Ltd.) | 30 g |
| Silane coupling agent (KBM-503, supplied from Shin-Etsu Chemical Co., Ltd.) | 17 g |
| 2-Propanol | 150 ml |

The above coating solution was applied on the cylindrical conductive support to make a film thickness 0.5 μm.

<Charge Generation Layer>

| | |
|---|---|
| Y type titanyl phthalocyanine (titanyl phthalocyanine having a maximum peak at 27.5° in Bragg's angle 2θ (± 2°) in X-ray diffraction spectral measurement specific for Cu-Kα) | 60 g, |
| silicone modified butyral resin (X-40-1211M supplied from Shin-Etsu Chemical Co., Ltd.) | 700 ml and |
| 2-butanone | 2000 ml |

were mixed and dispersed using a sand mill to prepare a charge generation layer coating solution. This coating solution was applied on the above undercoating layer by a dip coating method to form a charge generation layer with a film thickness of 0.2 μm.

<Charge Transport Layer>

| | |
|---|---|
| Charge transport material, N-(4-methylphenyl)-N-{4-(β-phenylstyryl)phenyl)-p-toluidine | 225 g, |
| Polycarbonate (viscosity mean molecular weight: 30,000) | 300 g, |
| Anti-oxidant (example compound 1-3) | 6 g |
| and | |
| Dichloromethane | 2000 ml |

were mixed and dissolved to prepare a charge transport layer coating solution. This coating solution was applied on the above charge generation layer by the dip coating method to form a charge transport layer with a dried film thickness of 20 μm.

<Protection Layer>

| | |
|---|---|
| Methyltrimethoxysilane | 150 g, |
| dimethyldimethoxysilane | 30 g, |
| reactive charge transport compound (example compound B-1) | 15 g, |
| polyvinylidene fluoride particles (volume mean particle size: 2 μm) | 10 g, |
| anti-oxidant (example compound 2-1) | 0.75 g, |
| 2-propanol | 75 g and |
| 3% acetic acid | 5 g |

were mixed to prepare a coating solution of a protection layer. This coating solution was applied on the above charge transport layer by a circular amount regulation type application apparatus to form a resin layer with a thickness of 2 μm, and heated/cured at 120° C. for one hour to form the protection layer of siloxane resin.

described in FIG. 2, the photoconductor P1 and the developer were loaded thereto, and the evaluation was carried out. The above digital copying machine was set to the following conditions to perform the evaluation.

Charging Condition

Charging device: Scorotron charging device, initial charging potential: 750V.

Exposure Condition

An exposure quantity was set to make an exposure site potential: −50 V.

Development Condition

DC bias: −550 V

Transfer pole: corona charging mode

At a fixing unit, a heating roller where iron was used as a core grid, the surface was coated with PFA (tetrafluoroethylene-fluoroalkylvinylether copolymer) with a thickness of 25 μm and a surface roughness, Ra was 0.8 μm was used, and a pressing roller where iron core grid was used, PFA tube with a thickness of 120 μm was coated on HTV silicone rubber and the surface roughness, Ra was 0.8 μm was used as the pressing roller. A nip width is 3.8 mm, and a line speed is 420 mm/sec.

1-3

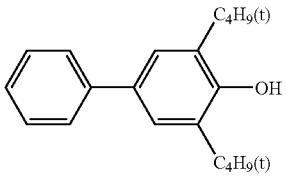

2-1

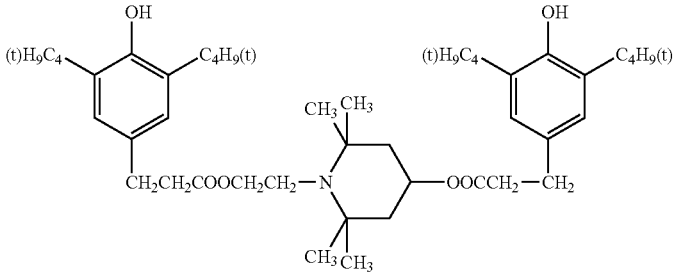

B-1

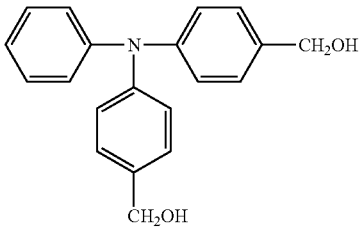

As a machine for evaluation, using a digital copying machine (having corona charging, laser exposure, reverse development, electrostatic transfer, claw separation and cleaning blade) having an image formation process A cleaning mechanism of the fixing unit and a silicone oil supplying mechanism are not loaded. A temperature of fixation was controlled by a surface temperature of the heating roller, and was made the set temperature at 165° C.

Continuous 0.5 million sheets were copied under a copying condition at low temperature and humidity (10° C., 20% RH) which appeared to be the most severe, and then non-visual offset property of copied images, twisting when fixed at a high speed, fixing roller lifetime, cleaning performance, occurrence of photoconductor filming, photoconductor lifetime, half tone uniformity and occurrence of smeared texts were evaluated.

For the evaluation, an original image where a text image with a pixel rate of 7%, a person face image, an all-white image and an all-black image were placed on quadrisection, respectively was copied using A4 size acid-free paper, and a half tone image, the all-white image, the all-black image and a thin line image were evaluated every 10,000 copies.

<Non-visual Offset Property>

A felt pad with 10 mm×50 mm and a thickness of 5 mm was abutted with a load of 50 g/cm$^2$ ($5\times10^{-5}$ Pa), and stain after printing 10,000 sheets was observed.

Evaluation Criteria

A: No occurrence of stain on the felt pad

B: Occurrence of slight stain on the felt pad (no practical problem)

D: Occurrence of stain on the felt pad image (practically problematic)

<Twisting when Fixed at a High Speed>

Twisting property and fixing rate were evaluated by changing a line speed setting from 420 mm/sec to 840 mm/sec as the temperature of heating roller was set at 165° C., and copying an all-one-color image every 20,000 sheet printing.

Evaluation Criteria

A: No paper jam due to poor fixation/separation and no claw mark of fixation/separation B: No paper jam due to poor fixation/separation but slight occurrence of claw mark of fixation/separation (no practical problem)

D: Occurrence of paper jam due to poor fixation/separation (practically problematic)

Plain paper of A4 size (weighing 65 g/m$^2$) was used for the measurement of the fixing rate.

<Fixing Roller Lifetime>

The lifetime of fixing roller was evaluated by the sheet number at the occurrence of image stain due to scratches on the fixing roller.

<Cleaning Performance>

The cleaning performance was evaluated by the sheet number of paper determined as image stain caused when the toner was sneaked through the cleaning unit onto the photoconductor possibly resulting in the stain on a white part of the image. The following A and B were regarded as acceptance.

Evaluation Criteria

A: No occurrence after printing 100 million sheets or more

B: Occurrence between 0.7 to 100 million sheets

D: Occurrence before printing 0.7 million sheets

<Stain at Bookbinding>

Double-sided copy was performed on plain paper with 64 g/m$^2$, a booklet of 100 sheet per volume was made and pages were turned over 20 times by a hand, and then stains on white parts were observed.

Rank A: No occurrence of stain on the image

Rank B: Extremely slight stain on the image but practically no problem at all.

Rank C: Slight stain on the image but practically no problem.

Rank D: Stains on the image and unsuitable for the practical use.

The evaluation ranks A, B and C were regarded as acceptance, and the rank D was regarded as rejection.

<Photoconductor Filming>

The presence or absence of filming was determined by visually observing the surface of the aforementioned photoconductor after continuously printing 100 million sheets. But, when the filming was remarkable before reaching 100 million sheets, the test was stopped at that sheet number, which was described as the last sheet number.

<Photoconductor Lifetime>

The lifetime of photoconductor was evaluated by the sheet number at the time point when a photographic fog density (relative density of a non-image part for a transfer paper) exceeded 0.01 when an exposure quantity was made maximum. The photographic fog density was measured by a reflection densitometer PDA-65 (supplied from Konica Corporation).

<Half Tone Uniformity>

Uniformity of half tone images in connection with transfer property variation such as photoconductor filming was evaluated. The evaluation criteria were as follows.

Rank A: Uniform image without unevenness

Rank B: Presence of streaking thin unevenness but no practical problem

Rank C: Presence of several streaking thin unevenness but no practical problem

Rank D: Presence of several or more streaking clear unevenness and practically problematic <Smeared Text>

Text images with 3 and 5 points were formed, and evaluated by the following evaluation criteria.

A: Both texts of 3 and 5 points are clear, easily legible and practically no problem B: Texts of 3 point are partially illegible but texts of 5 point are clear, easily legible and practically no problem D: Most texts of 3 point are illegible, texts of 5 point are partially or totally illegible, and practically problematic The results for the above evaluation items are shown in Table 3.

TABLE 3

| | NON-VISUAL OFFSET PROPERTY | TWISTING WHEN FIXED AT A HIGH SPEED | FIXING ROLLER LIFETIME | CLEANING PER-FORMANCE | STAIN AT BOOK-BINDING | PHOTOCONDUCTOR FILMING | HALF TONE UNI-FORMITY | SMEARED TEXT | PHOTOCONDUCTOR LIFETIME |
|---|---|---|---|---|---|---|---|---|---|
| EXAMPLE 1 | A | A | 1 MILLION SHEETS OR MORE | A | A | NO OCCURRENCE UNTIL PRINTING 1 MILLION SHEETS | A | A | 1 MILLION SHEETS OR MORE |
| EXAMPLE 2 | A | A | 1 MILLION SHEETS OR MORE | A | B | NO OCCURRENCE UNTIL PRINTING 1 MILLION SHEETS | B | A | 1 MILLION SHEETS OR MORE |
| EXAMPLE 3 | A | A | 1 MILLION SHEETS OR MORE | A | B | NO OCCURRENCE UNTIL PRINTING 1 MILLION SHEETS | B | A | 1 MILLION SHEETS OR MORE |
| EXAMPLE 4 | A | A | 1 MILLION SHEETS OR MORE | A | B | NO OCCURRENCE UNTIL PRINTING 1 MILLION SHEETS | B | A | 1 MILLION SHEETS OR MORE |
| EXAMPLE 5 | A | A | 1 MILLION SHEETS OR MORE | A | B | NO OCCURRENCE UNTIL PRINTING 1 MILLION SHEETS | B | B | 1 MILLION SHEETS OR MORE |
| EXAMPLE 6 | A | B | 1 MILLION SHEETS OR MORE | A | B | NO OCCURRENCE UNTIL PRINTING 1 MILLION SHEETS | B | B | 1 MILLION SHEETS OR MORE |
| EXAMPLE 7 | B | B | 1 MILLION SHEETS OR MORE | A | B | NO OCCURRENCE UNTIL PRINTING 1 MILLION SHEETS | B | B | 1 MILLION SHEETS OR MORE |
| EXAMPLE 8 | B | B | 0.75 MILLION SHEETS OR MORE | B | C | NO OCCURRENCE UNTIL PRINTING 1 MILLION SHEETS | C | B | 0.75 MILLION SHEETS |
| EXAMPLE 9 | B | B | 0.75 MILLION SHEETS OR MORE | B | C | NO OCCURRENCE UNTIL PRINTING 1 MILLION SHEETS | B | B | 0.75 MILLION SHEETS |
| EXAMPLE 10 | B | B | 0.75 MILLION SHEETS OR MORE | A | C | NO OCCURRENCE UNTIL PRINTING 1 MILLION SHEETS | B | B | 0.75 MILLION SHEETS |
| COMPARATIVE EXAMPLE 1 | D | D | 0.4 MILLION SHEETS OR MORE | A | D | 0.5 MILLION SHEETS | D | D | 0.5 MILLION SHEETS |
| COMPARATIVE EXAMPLE 2 | D | D | 0.3 MILLION SHEETS OR MORE | B | D | 0.5 MILLION SHEETS | D | D | 0.5 MILLION SHEETS |
| COMPARATIVE EXAMPLE 3 | D | D | 0.3 MILLION SHEETS OR MORE | B | D | 0.5 MILLION SHEETS | D | D | 0.5 MILLION SHEETS |
| COMPARATIVE EXAMPLE 4 | D | D | 0.25 MILLION SHEETS | D | D | 0.5 MILLION SHEETS | D | D | 0.5 MILLION SHEETS |
| COMPARATIVE EXAMPLE 5 | B | B | 0.7 MILLION SHEETS OR MORE | D | D | 0.2 MILLION SHEETS | D | D | 0.2 MILLION SHEETS |
| COMPARATIVE EXAMPLE 6 | D | D | 0.25 MILLION SHEETS | B | C | 0.75 MILLION SHEETS | C | B | 0.5 MILLION SHEETS |

As is also obvious from the results in the above Table 3, in the toner for electrostatic latent image development of the invention it has been confirmed that occurrence suppression of non-visual offset is accomplished and that the fixing unit can be continuously used over the long term of 0.75 million sheets or more without the need to exchange the members. The result that the lifetime of photoconductor can be extended to a large extent has been obtained, and it has been confirmed that the toner of the invention has much more excellent performances than the toner for electrostatic latent image development of the conventional art used as the comparative samples.

In the above, the Examples of the present invention are explained. However, it is needless to say that the present invention is not limited to such Examples, but various modifications are possible in a range within the scope of the present invention.

According to the invention, firstly, it is possible to provide the toner for electrostatic latent image development, which is excellent in non-visual offset property and causes no image stain even when a cumulative sheet number of processing is increased along with the long term use.

Secondly, it is possible to provide the toner for electrostatic latent image development which is excellent in melting property and fluidity, where exudation of the mold release agent onto the surface of toner is effectively performed and there is no occurrence of fixation twisting jam due to a lack of the mold release property even when used for a high speed machine.

Thirdly, it is possible to provide the toner for electrostatic latent image development having durability where detachment of the mold release agent from inside the toner is not caused.

Fourthly, it is possible to provide the toner for electrostatic latent image development capable of being used for a high speed image forming apparatus having a fixing with oilless or no cleaning mechanism.

Furthermore fifthly, it is possible to provide an image forming method using the above toner for electrostatic latent image development.

What is claimed is:

1. Toner for electrostatic latent image development comprising at least a resin, a coloring agent and a crystalline compound wherein;

toner particles have a sea-island structure, in which a mean value of distances between most proximal walls between islands of the crystalline compound is from 100 to 1060 nm, and percentage of the islands of the crystalline compound in which the distance between the most proximal walls is 1300 nm or more is 10% or less by number in the total islands of the crystalline compound;

the crystalline compound comprises 92% or more by mass of n (normal)-paraffin, and a plurality of types of n-paraffin components with different numbers of carbons, and a peak top temperature of a largest endothermic peak is from 70 to 120° C. in an endothermic curve measured by DSC, a peak width at half height of the largest endothermic peak is 12° C. or less, and a penetration is 4 or less; and wherein 98% or more of the toner particles have no island which is exposed on the toner particle surface.

2. The toner of claim 1, wherein the mean value of distances between the most proximal walls between the islands of the crystalline compound is from 260 to 820 nm, and percentage of the islands of the crystalline compound in which the distance between the most proximal walls is 1300 nm or more is 4% or less by number in the total islands of crystalline compound.

3. The toner of claim 1, comprising a sea part of the resin, islands of the coloring agent and the islands of the crystalline compound.

4. The toner of claim 1, wherein a spectral transmittance of a free extraction solution of the crystalline compound is from 70.0 to 99.5%.

5. The toner of claim 1, wherein a number mean particle size of toner particles is from 3 to 9 μm.

6. The toner of claim 1, comprising the resin and coloring particles comprising the coloring agent, wherein the coloring particles comprise at least the coloring particles obtained by polymerizing polymerizable monomer in aqueous vehicle.

7. The toner of claim 1, comprising the resin and coloring particles comprising the coloring agent, wherein the coloring particles comprise at least the coloring particles obtained by aggregating/fusing resin particles in aqueous vehicle.

8. The toner of claim 1, wherein the toner is obtained by aggregating/fusing composite resin fine particles obtained by multistage polymerization and coloring agent particles.

9. The toner of claim 1, wherein a melting point of the crystalline compound is 70 to 120° C.

10. The toner of claim 1, comprising the crystalline compound in which a content of the n-paraffin is 94% or more.

11. The toner of claim 1, comprising the crystalline compound in which a kinetic viscosity at 100° C. is 20 $mm^2/s$ or less.

12. The toner of claim 1, comprising the crystalline compound in which mean carbon number of the n-paraffin molecules is 30 to 55.

13. The toner of claim 1, wherein an endothermic quantity of a peak in a range of 70 to 120° C. in the endothermic curve in the DSC is from 4 to 30 J/g.

14. An image forming method comprising forming a visual image by developing an electrostatic latent image formed on a photoconductor with the toner of claim 1, transferring and fixing by heat fixing the developed visual image onto a recording material.

15. The image forming method of claim 14, wherein the heat fixing is performed at a line speed of from 230 to 900 mm/sec.

16. The image forming method of claim 14, wherein the mean value of distances between the most proximal walls between the islands of the crystalline compound is from 260 to 820 nm, and percentage of the islands of the crystalline compound in which the distance between the most proximal walls is 1300 nm or more is 4% or less by number in the total islands of the crystalline compound.

17. The image forming method of claim 14, wherein a spectral transmittance of a free extraction solution of the crystalline compound is from 70.0 to 99.5%.

18. The image forming method of claim 14, wherein a melting point of the crystalline compound is 70 to 120° C.

19. The image forming method of claim 14, wherein a number mean particle size of the toner particles is from 3 to 9 μm.

* * * * *